US006289189B1

(12) United States Patent
Numagami et al.

(10) Patent No.: US 6,289,189 B1
(45) Date of Patent: Sep. 11, 2001

(54) PROCESS CARTRIDGE AND ELECTROPHOTOGRAPHIC IMAGE FORMING APPARATUS HAVING A MAIN ASSEMBLY IN WHICH A CARTRIDGE COUPLING MEMBER IS ENGAGEABLE WITH A MAIN ASSEMBLY COUPLING MEMBER TO RECEIVE A DRIVING FORCE

(75) Inventors: Atsushi Numagami, Hadano; Satoshi Sugita, Yokohama; Hisayoshi Kojima, Mishima; Kazunari Murayama, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/468,941

(22) Filed: Dec. 22, 1999

(30) Foreign Application Priority Data

Dec. 28, 1998 (JP) ..... 10-372583

(51) Int. Cl.[7] ..... G03G 21/16
(52) U.S. Cl. ..... 399/111; 399/117
(58) Field of Search ..... 399/111, 112, 399/116, 117, 159, 167; 492/21, 47

(56) References Cited

U.S. PATENT DOCUMENTS

| | | | |
|---|---|---|---|
| 5,235,383 | 8/1993 | Tada et al. | 355/200 |
| 5,249,026 | 9/1993 | Kojima | 355/327 |
| 5,283,616 | 2/1994 | Numagami et al. | 355/245 |
| 5,383,011 | 1/1995 | Numagami et al. | 355/298 |
| 5,442,421 | 8/1995 | Kojima | 355/211 |
| 5,471,284 | 11/1995 | Fujii et al. | 355/210 |
| 5,497,220 | 3/1996 | Inomata et al. | 355/245 |
| 5,500,714 | 3/1996 | Yashiro et al. | 355/200 |
| 5,521,693 | 5/1996 | Kojima et al. | 355/326 |
| 5,543,898 | 8/1996 | Shishido et al. | 355/210 |
| 5,585,895 | 12/1996 | Yashiro et al. | 355/215 |
| 5,617,579 | 4/1997 | Yashiro et al. | 399/114 |
| 5,689,774 | 11/1997 | Shishido et al. | 399/111 |
| 5,768,658 | 6/1998 | Watanabe et al. | 399/111 |
| 5,790,923 | 8/1998 | Oguma et al. | 399/106 |
| 5,920,753 | 7/1999 | Sasaki et al. | 399/111 |
| 5,937,239 | 8/1999 | Watanabe et al. | 399/111 |
| 5,937,242 | 8/1999 | Yokoyama et al. | 399/114 |
| 5,940,657 | 8/1999 | Yokomori et al. | 399/119 |
| 5,950,049 | 9/1999 | Yokomori et al. | 399/119 |
| 5,963,759 | 10/1999 | Kojima et al. | 399/111 |
| 5,966,566 | 10/1999 | Odagawa et al. | 399/109 |
| 5,966,568 | 10/1999 | Numagami et al. | 399/111 |
| 6,006,058 | 12/1999 | Watanabe et al. | 399/167 |
| 6,016,413 | 1/2000 | Yokoyama et al. | 399/113 |
| 6,029,032 | 2/2000 | Watanabe et al. | 399/111 |
| 6,072,968 * | 6/2000 | Nomura et al. | 399/113 |

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

A process cartridge detachably mountable to a main assembly of an image forming apparatus, includes an electrophotographic photosensitive drum having a coupling member at one end thereof. The process cartridge is detachably mountable in a direction of an axis of the electrophotographic photosensitive drum. The cartridge also includes a process device actable on the electrophotographic photosensitive drum, and a projected shaft projected from the coupling member of the electrophotographic photosensitive drum. The projected shaft is engageable with a hole of an engaging member provided in the main assembly.

9 Claims, 18 Drawing Sheets

PROCESS CARTRIDGE AND ELECTROPHOTOGRAPHIC IMAGE FORMING APPARATUS HAVING A MAIN ASSEMBLY IN WHICH A CARTRIDGE COUPLING MEMBER IS ENGAGEABLE WITH A MAIN ASSEMBLY COUPLING MEMBER TO RECEIVE A DRIVING FORCE

FIELD OF THE INVENTION AND RELATED ART

The present invention relates to an electrophotographic image forming apparatus, a process cartridge detachably mountable to a main assembly thereof and an electrophotographic photosensitive drum.

In this specification, an electrophotographic image forming apparatus means an image forming apparatus which employs an electrophotographic system to form images or recording medium For example, it includes electrophotographic copying machines, electrophotographic printers (laser beam printers, LED printers, and the like), facsimile machines, word processors, and the like.

A process cartridge means a cartridge which integrally comprises a charging means, a developing means or a cleaning means, and an electrophotographic photosensitive drum, and which is rendered removably installable in the main assembly of an electrophotographic image forming apparatus. It also means a cartridge comprising at least a charging means, a developing means, or cleaning means, in addition to an electrophotographic photosensitive drum, and is rendered removably installable in the main assembly of an electrophotographic image forming apparatus. It also means a cartridge comprising at least a developing means, and an electrophotographic photosensitive drum, and which is rendered removably installable in the main assembly of an electrophotographic image forming apparatus.

In the past, an image forming apparatus which employed an electrophotographic image formation process employed a process cartridge system, according to which an electrophotographic photosensitive member, and one or a plurality of processing means which works ion the electrophotographic photosensitive member, are integrally assembled in the form of a cartridge removably installable in the main assembly of an image forming apparatus. Also according to this process cartridge system, the maintenance for an image forming apparatus can be performed by a user him/herself; the user does not need to rely on a service person for the maintenance. Therefore, the employment of a process cartridge system drastically improved the operational efficiency of an image forming apparatus. As a result, a process cartridge system has been widely used in the field of the image forming apparatus.

Such a process cartridge is provided with a rotating force receiving portion for receiving a rotating force from the main assembly of the apparatus, which is rotatably supported on the cartridge frame.

For the purpose of the centering between the photosensitive drum and the driving member of the main assembly of the apparatus, the positional alignment between the cartridge frame and the main assembly of the apparatus is carried out in the prior art.

The present invention is intended to provide a further development.

SUMMARY OF THE INVENTION

Accordingly, it is a principal object of the present invention to provide a process cartridge, an electrophotographic image forming apparatus and an electrophotographic photosensitive drum wherein deviation of the centers of the shaft of the electrophotographic photosensitive drum and a driving shaft of the main assembly can be suppressed.

It is another object of the present invention to provide a process cartridge, an electrophotographic image forming apparatus and an electrophotographic photosensitive drum wherein an alignment between the shaft of the electrophotographic photosensitive drum and a driving shaft of the main assembly can be accomplished with high accuracy.

It is a further object of the present invention to provide a process cartridge, an electrophotographic image forming apparatus and an electrophotographic photosensitive drum where the photosensitive drum and a driving member of the main assembly of the image forming apparatus are directly centered with each other, and the wherein the drive transmission from the main assembly of the image forming apparatus to the process cartridge is effected around the axis of the photosensitive drum.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the appended drawings.

In the following description, the longitudinal direction means the direction perpendicular to the direction in which recording medium is conveyed, and parallel to the surface of the recording medium. The left or right side means the left or right side of the recording means as seen from above, and upstream in terms of the conveyance direction of the recording medium. The top side of a process cartridge means the top side of a process cartridge after the process cartridge is properly installed.

Figure 1:
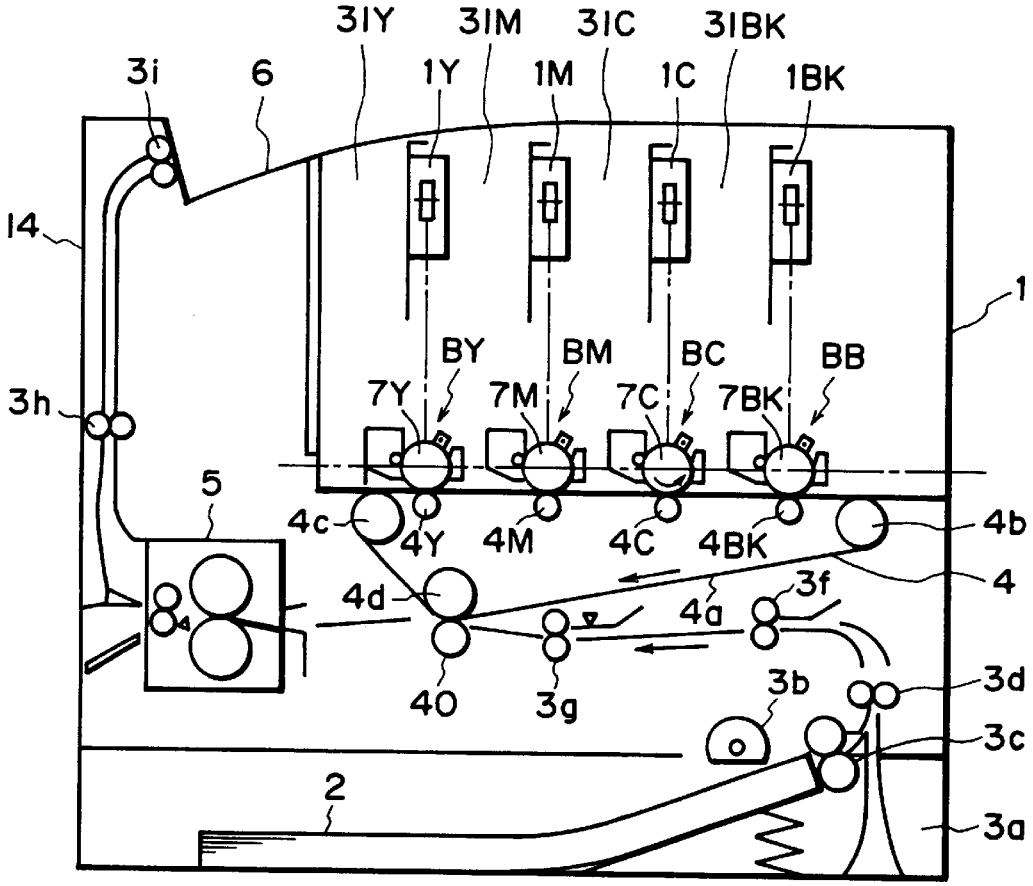
FIG. 1 is a vertical section of an electrophotographic image forming apparatus.

FIG. 1 is a schematic sectional view of an image forming apparatus to which the present invention is applicable. The image forming apparatus in this drawing is provided with image forming portion 31Y, 31M, 31C and 31Bk for forming a toner image on a photosensitive drum, ire., an image bearing member, an intermediary transfer belt 4*a* onto which the toner image is temporarily transferred, a secondary transfer roller 40, i.e., a transferring means, for transferring the toner image on the belt 4*a*, onto a recording medium 2, a sheet feeding means for conveying and feeding the recording medium 2 between the intermediary transfer belt 4*a* and secondary transfer roller 40, a conveying means for conveying the recording means 2 to the transferring means, a fixing means, and a sheet discharging means.

Next, an image formation will be described.

As shown in the drawing, the image forming apparatus comprises a sheet feeder cassette 3*a*, which is capable of storing plural sheets of recording medium 2 (for example, recording paper, OHP sheet, fabric, or the like), and is removably installable in the image forming apparatus. In operation, the sheets of recording medium are fed out of the sheet feeder cassette 3*a* by a pickup roller 3*b*, and are conveyed to a retard roller pair 3*b*, which separates the recording medium sheets and releases them one by one. Then, the recording sheets are conveyed one by one to a registration roller pair 3*g*, by conveyer rollers 3*d* and 3*f*.

At the moment of the arrival of the conveyed recording medium 2 at the registration roller pair 3*g*, the registration roller pair 3*g* is standing still, and as the recording medium 2 comes into contact with the nip of the registration roller pair, if it is skewed, it is correctly aligned.

In the case of a four drum type full-color system, four process cartridges BY (yellow), BM (magenta), BC (cyan) and BB (black), each of which comprises an image bearing member, are aligned as shown in the drawing. The system is also provided with four optical scanning systems 1Y, 1M, 1C and 1Bk, which correspond to the process cartridges BY, BM, BC and BB. In operation, a toner image is formed on the photosensitive drum in each of the process cartridges BY, BM, BC and BB, in response to image signals, and then, the images are transferred in layers by the corresponding transfer rollers 4 (4Y, 4M, 4C and 4BK), onto the intermediary transfer belt 4*a* which is running in the direction indicated by an arrow mark.

Thereafter, the toner images on the intermediary transfer belt 4*a* are transferred onto the recording medium 2 which is delivered to the nip between the secondary transfer roller 40 and the intermediary transfer belt 4*a*, with a predetermined timing. Then, the toner images are fixed to the recording medium 2, in a fixing apparatus, and then, the recording medium 2 is discharged into the tray 6 located at the top of the apparatus main assembly 14, by a pair of discharge rollers 3*h* and 3*i*.

In each of the aforementioned image forming portion 31Y. 31M, 31C and 31Bk, the components, exclusive of the optical scanning system (1Y, 1M, 1C or 1Bk), are components of a process cartridge (BY, BM, BC and BB). Since all the process cartridges in this image forming apparatus are the same in structure, the process cartridge structure will be described with reference to the process cartridge BY.

Figure 2:
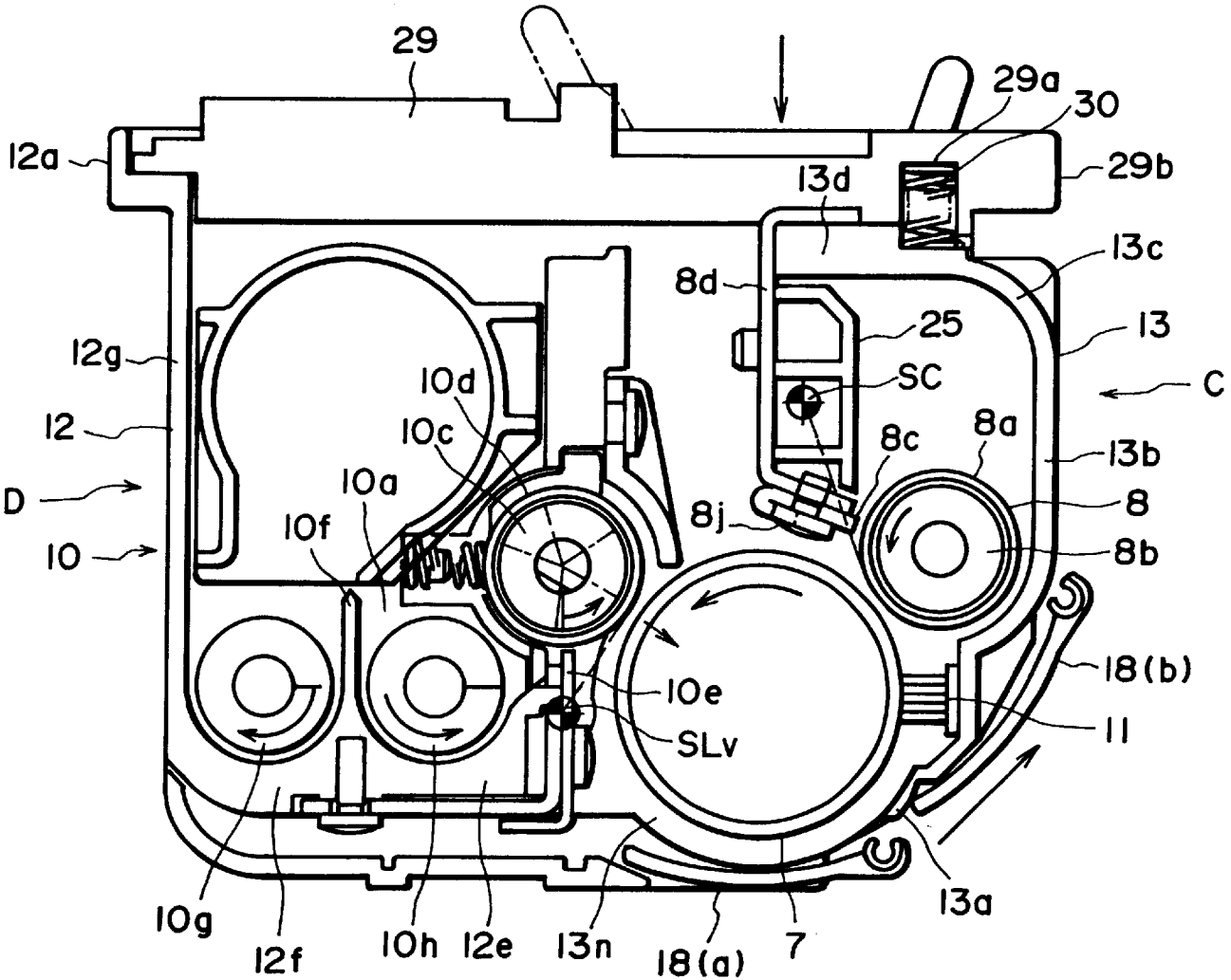
FIG. 2 is a vertical sectional view of a process cartridge.

Referring to FIG. 2, in the process cartridge BY, a charging means, an exposing portion, a developing means, and a transfer opening, are arranged around the peripheral surface of a photosensitive drum 7. In this embodiment, two component developer which contains magnetic carrier is used. Therefore, an organic photoconductor or the like, which is commonly used, can be used as the material for the photosensitive drum 7, it is desired that the surface of the photosensitive material of the photosensitive drum 7 is coated with a surface layer, the electrical resistance of which is in a range of $10^2$–$10^{14}$ cm. Also, it is desired that amorphous silicon is used as the photosensitive material for the photosensitive drum 7. This is because such a photosensitive drum makes it possible for electrical charge to be injected into the photosensitive drum 7, contributing to the prevention of ozone generation and reduction in electrical energy consumption. It also can improve charge efficiency.

Thus, the photosensitive drum 7 in this embodiment was formed by coating negatively chargeable organic material on the peripheral surface of an aluminum drum,.

The charging means is a magnetic brush type charging device which employs magnetic carrier.

The charging device 8 comprises a charge roller 8*a*, which is a hollow cylindrical roller and is rotatively supported, and a magnet 8*b* fixedly placed within the charge roller 8*a*. After the primary transfer, the toner which remains on the peripheral surface of the photosensitive drum 7 is taken into the charging device 8 which rotates in the direction indicated by an arrow mark.

As for the developing means 10 in this embodiment, a method which uses a two component magnetic brush for developing latent image, is employed (two component based non-contact development).

FIG. 2 also shows the developing means 10 in this embodiment, which uses the two component magnetic brush. A development sleeve 10*d* is a hollow cylindrical member, and is rotatively supported. Within the development sleeve 10*d*, a magnet 10*c* is fixedly disposed The development sleeve 10*d* is rotated in the same direction as the photosensitive drum 7. More specifically, the development sleeve 10*d* and photosensitive drum 7 are rotated in such directions that the peripheral surfaces of the development sleeve 10*d* and photosensitive drum 7 move in the opposite directions at the point where they come closest to each other. The photosensitive drum 7 and development sleeve 10*d* remain not in contact with each other; a gap in a range of 0.1–1.0 mm is maintained between them so that developer is allowed to contact the peripheral surface of the photosensitive drum 7 to develop the image on the peripheral surface of the photosensitive drum 7.

Toner mixed with carrier is placed in a casing partitioned with partitioning wall 10 which in extends in the longitudinal direction. Within the casing, stirring screws 10*g* and 10*h* are provided to move the toner within the casing. After being supplied into the casing from an unillustrated toner supply container, the toner lands in the casing, adjacent to one of the longitudinal ends of the stirring screw 10*g*, and then, is conveyed toward the other longitudinal end, while being stirred, by the stirring screw 10*g*. Arriving at the other longitudinal end, the toner moves into the space on the other side of the partitioning wall 10, through the hole in the partitioning wall 10*f*, and then, is conveyed, while being stirred, by the stirring screw 10*h*, back to the opposite longitudinal end, i.e., the longitudinal end from which it began to be conveyed. Then, the toner moves back into the original space through another hole in the partitioning wall 10. In other words, the toner is circulated, while being stirred, in the casing, by the stirring screws 10*g* and 10*h*.

At this point, the development process for visualizing the electrostatic latent image formed on the photosensitive drum 7, with the use of a developing apparatus 4 which employs a developing method based on a magnetic brush comprising two components, will be described along with the system for circulating the developer. First, as the development sleeve 10*d* rotates, the developer is picked up to the peripheral surface of the development sleeve 10*d* by the poles of the magnet 10*c*. Then, as the development sleeve 10*d* rotates further, the developer on the peripheral surface of the development sleeve 10*d* is regulated in thickness by a regulating blade 10*e* positioned perpendicular to the peripheral surface of the development sleeve 10*d*. As a result, a thin layer of developer is formed on the peripheral surface of the development sleeve 10*d*. As the development sleeve 10*d* rotates further, the developer particles in the thin layer of developer aggregate in the form of a brush, across the portion corresponding to the primary pole of the magnet, i.e., the development pole, of the magnet 10*c*. The latent image on the photosensitive drum 7 is developed (visualized) by the toner particles in this aggregate of developer particles in the form of a brush, into a toner image. Thereafter, the thin layer of developer is returned to the developer container 10*a* by the repulsive magnetic field.

To the development sleeve 10*d*, DC and AC voltages are applied from unillustrated power sources. In the case of a two component based developing method, application of AC voltage generally increases development efficiency, and improves image quality. However, it creates an environment in which a resulting image tends to suffer from "fog". Thus, when AC voltage is applied, normally, difference in potential level is provided between the DC voltage applied to the development sleeve 10*d*, and the surface charge of the photosensitive drum 7, so that toner is prevented from adhering to the non-image areas of the photosensitive drum 7 during the development process.

The thus developed toner image is transferred onto the intermediary transfer belt 4*a* by the. intermediary transferring apparatus 4, which comprises an endless belt 4*a*, a driver roller 4*b*, a follower roller 4*c*, and a counter roller 4*d* for secondary transfer. The endless belt 4*a* are stretched around the rollers 4*b*, 4*c* and 4*d*, and is rotatively driven in the direction indicated by an arrow in FIG. 1. Within the loop of the transfer belt 4*a*, transfer charge rollers 4Y, 4M, 4C and 4Bk are disposed in contact with the belt 4*a*, on the inward side of the belt loop, to apply pressure upon the belt 4*a*, against the photosensitive drum 7, while being supplied with voltage from a high voltage source, that is, while being charged to the polarity opposite to the polarity of the toner. As a result, the toner images on the photosensitive drums 7 in the process cartridges are sequentially transferred onto the intermediary transfer belt 4*a*, on the top side.

As for the material for the intermediary transfer belt 4*a*, polyimide can be used. However, it does not need to be limited to polyimide. For example, other dielectric plastics such as polycarbonate, polyethylene terephthalate, polyfluoro-vinylidene, polyethylene-naphthalate, polyether ether keton, polyethersulfon, and polyurethane, and rubber such as fluorinated rubber and silicon rubber, may be used with good results.

After the image transfer, a certain amount of toner remains on the peripheral surface, of the photosensitive drum 7 (transfer-residual toner). If this transfer-residual toner is passed as it is through the charging device, the photosensitive drum 7 fails to be charged to the predetermined potential level, across the portions corresponding to the residual image (residual toner image) during the following image formation, and/or the following image becomes light or dark, across the portions corresponding to the preceding image (hereinafter, this phenomenon is called a ghost). In other words, even after the transfer-residual toner passes through the charging station in which the charging magnetic brush is in contact with the photosensitive drum 7, the residual image, or the image formed by the residual toner, remains virtually undisturbed. Therefore, it is necessary to take the transfer-residual toner into the magnetic brush based charging device 8, as the transfer-residual toner passes the charging station as the photosensitive drum 7 rotates, so that the history or trace of the preceding image is removed. If AC voltage is applied to the magnetic brush based charging device 8 during this process of removing the transfer-residua toner, an oscillating electric field is generated between the photosensitive drum 7 and charging device 8, which makes it easier for the toner to be taken into the charging device 8. Although, in many situations, the residual toner on the photosensitive drum 7 is a mixture of the positively charged toner particles and the negatively charged toner particles, which are created by the separation discharge or the like which occurs during the transfer process, it is desired, in consideration of the ease with which the transfer-residual toner can be taken into the magnetic brush based charging device 8, that the polarity of the transfer-residual toner is positive.

In this embodiment, therefore, an electrically conductive brush 11 is placed in contact with the photosensitive drum 7, between the intermediary transferring apparatus 4 and magnetic brush based charging device 8, to apply bias having the polarity opposite to the charge bias. With this arrangement, the positively charged toner particles in the transfer-residual toner pass the magnetic brush based charging device 8, whereas the negatively charged toner particles in the transfer-residual toner are temporarily captured by the electrically conductive brush 11, being thereby robbed of their negative polarity, and then, are spit out back onto the photosensitive drum 7 This process makes it easier for the transfer-residual toner to be attached to the magnetic brush.

(Frame Structure of Process Cartridge)

The process cartridge B (BY, BM, BC and BB) in this embodiment comprises a development unit D and a charge unit C, which are connected to each other. The development unit D is provided with an electrophotographic photosensitive drum 7, a developing means 10, and a development unit frame 12 in which the drum 7 and cleaning means are mounted. The charge unit C is provided with a charge roller 8*a*, a regulator blade 8*c*, a charge brush 11, and a charge unit frame 13 in which the roller 3*a*, blade 8*c*, brush 11, and the like, are mounted. The connected development unit D and charge unit C are covered on the front and rear sides, with a front cover 16 and cover 17 (FIG. 4), respectively, to properly position them relative to each other.

Referring to FIG. 2, the process cartridge B is also provided with a shutter 1*a*, which covers or exposes a transfer opening by moving between positions (a) and (b), respectively. The transfer opening is provided between the development unit frame 12 and charge unit frame 13 The shutter 18 is a component which prevents the photosensitive drum 7 from being damaged by its exposure to the external light, or due to mishandling, when the process cartridge B is out of the image forming apparatus, and which opens to allow the photosensitive drum 7 to make contact with the intermediary transfer belt 4*a* after the installation of the process cartridge B into the main assembly 14 of the image forming apparatus.

Because bias is applied to the electrically conductive brush 11, the transfer-residual toner electrically adheres to the electrically conductive brush 11, on the side of the intermediary transferring apparatus 4, If the transfer-residual toner adheres to the electrically conductive brush 11, by a certain amount or more, the toner falls off due to the vibration which occurs when the process cartridge B is removed from the apparatus main assembly 14, or is moved, and the fallen toner contaminates the hands and clothes of the user, the surfaces of the desk or floor on which the process cartridge B is placed when the process cartridge B is exchanged. The Shutter 18 is also effective to prevent this kind of problem.

Figure 3:
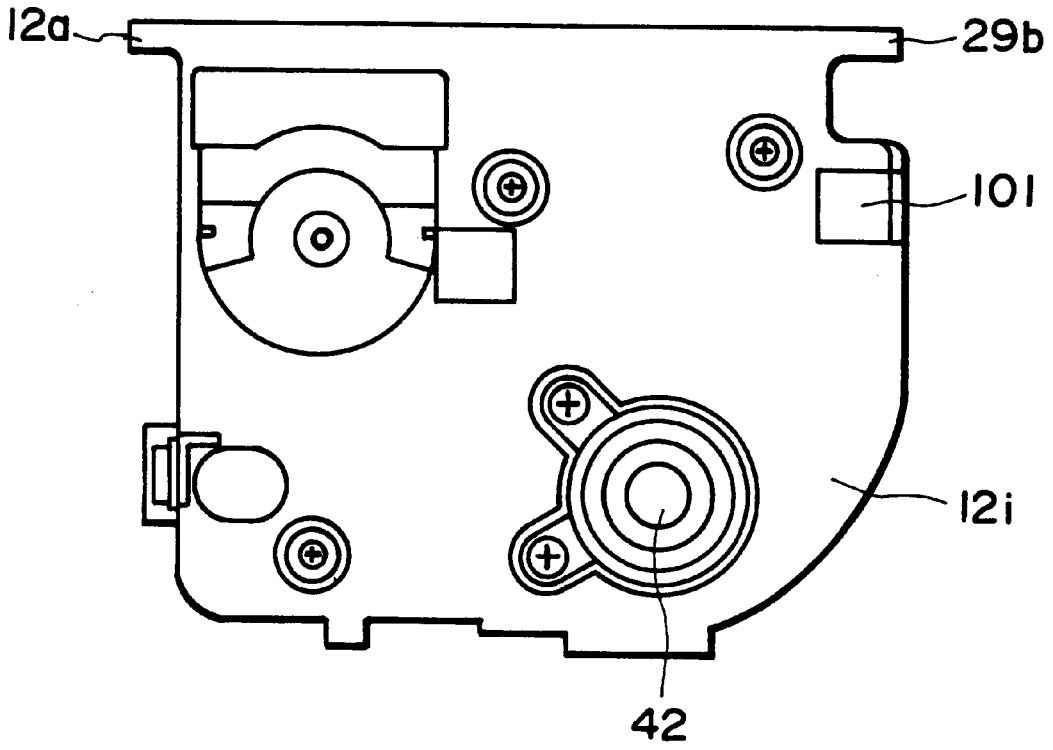
FIG. 3 is a front view of a process cartridge.
Figure 4:
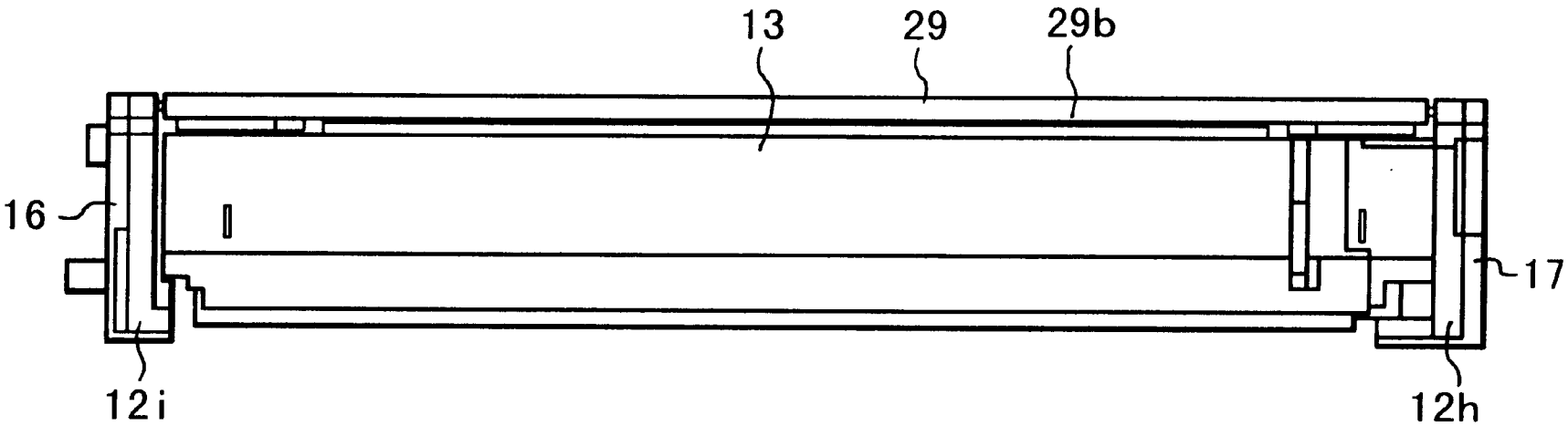
FIG. 4 is a right side view of the process cartridge.
Figure 5:
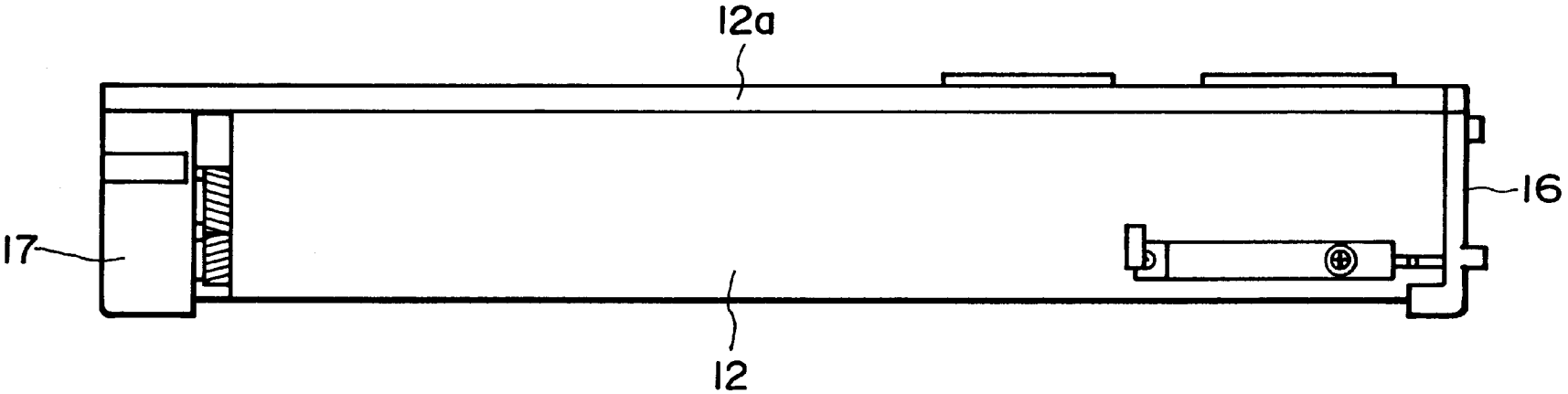
FIG. 5 is a left side view of the process cartridge.
Figure 6:
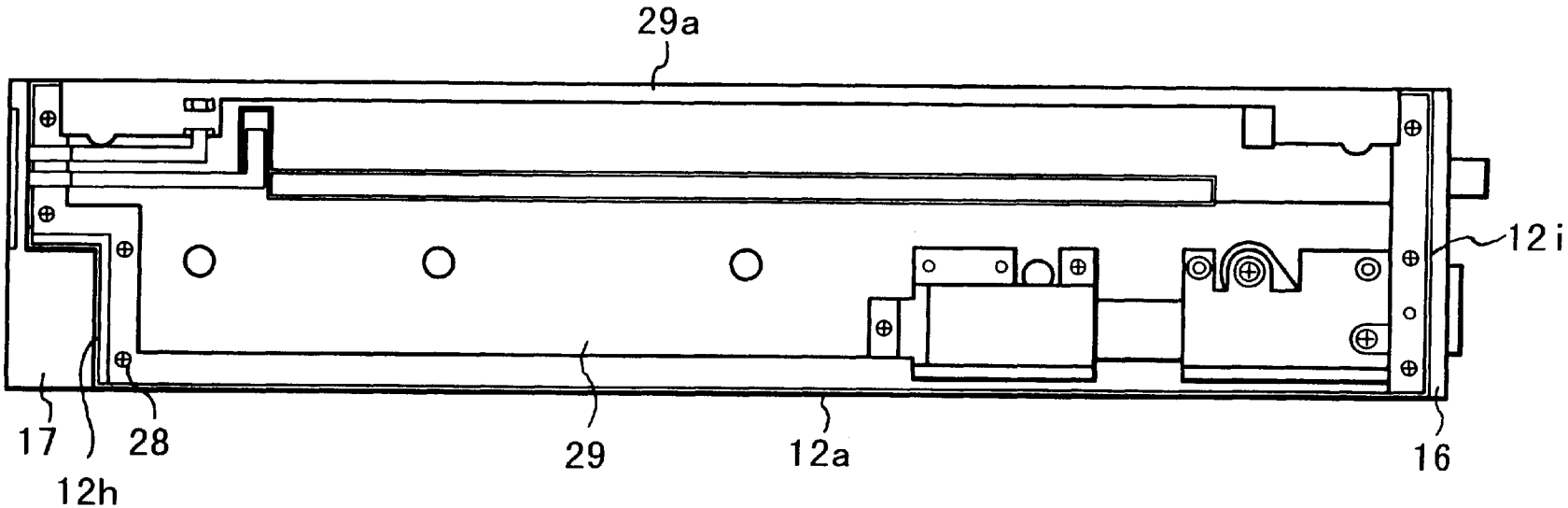
FIG. 6 is a top view of the process cartridge.
Figure 7:
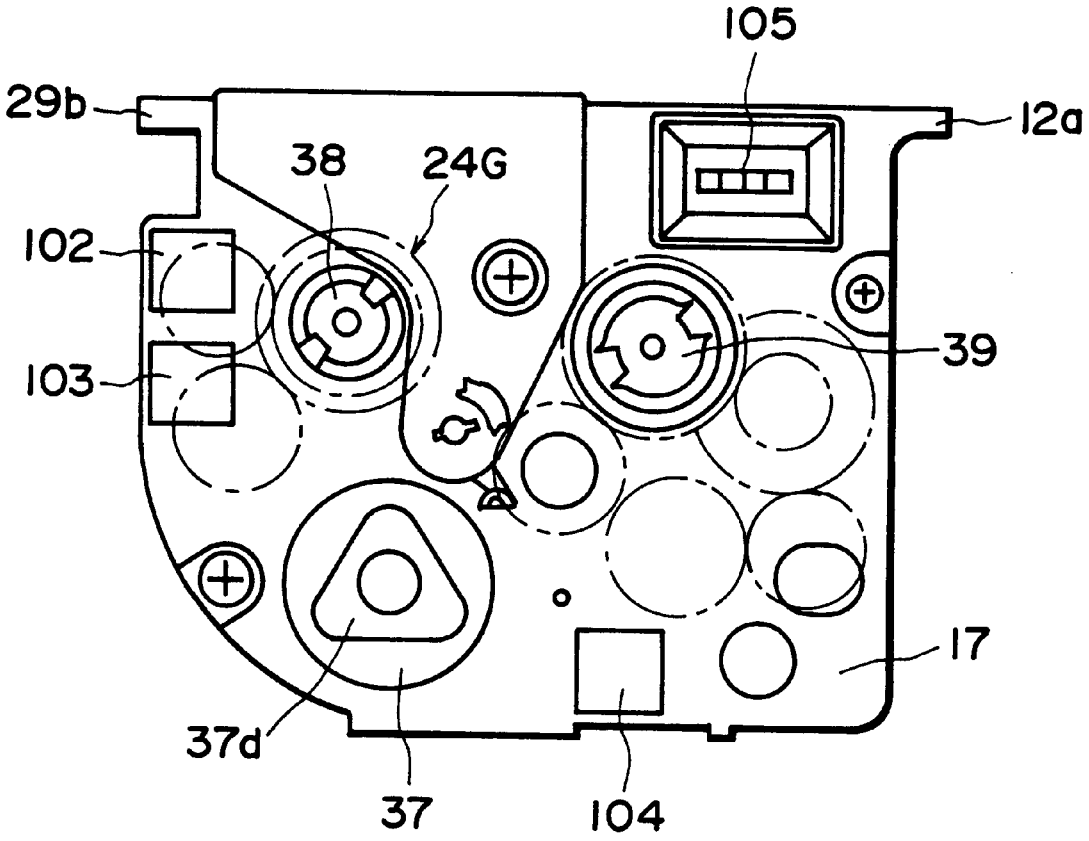
FIG. 7 in a rear view of the process cartridge.
Figure 8:
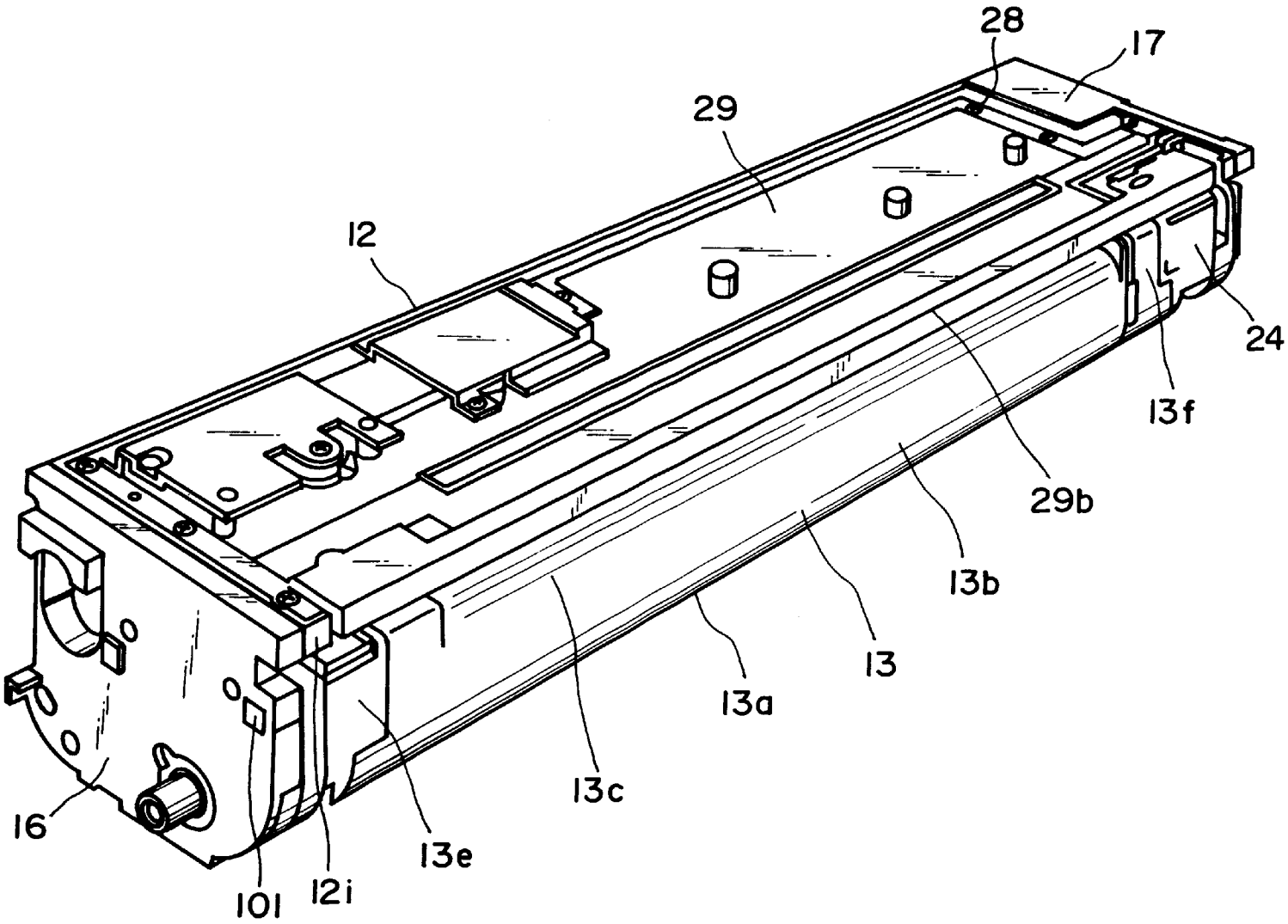
FIG. 8 is a perspective view of the process cartridge, as seen, from the right front.
Figure 9:
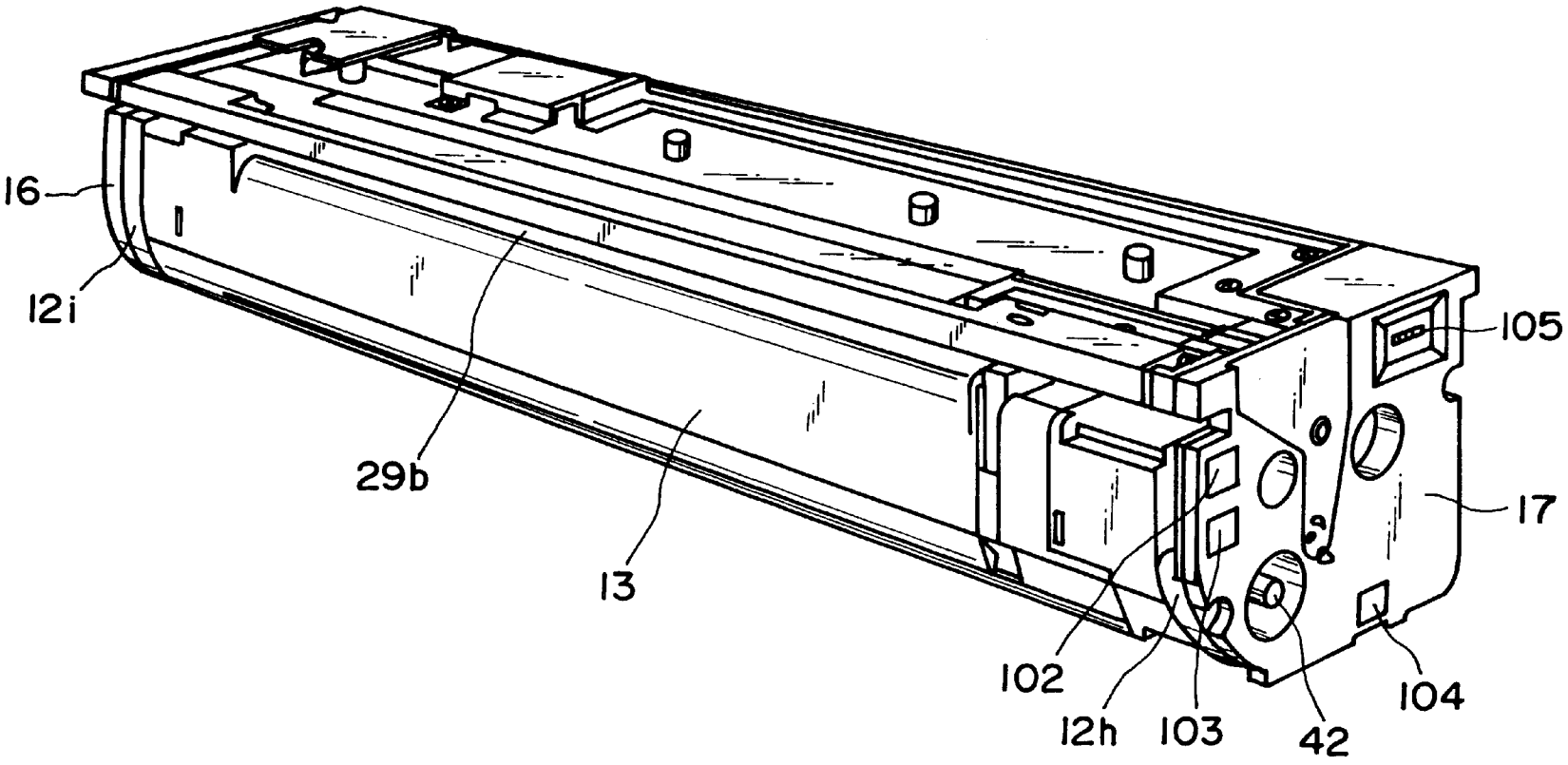
FIG. 9 is a perspective view of the process cartridge, as seen from the left rear.
Figure 10:
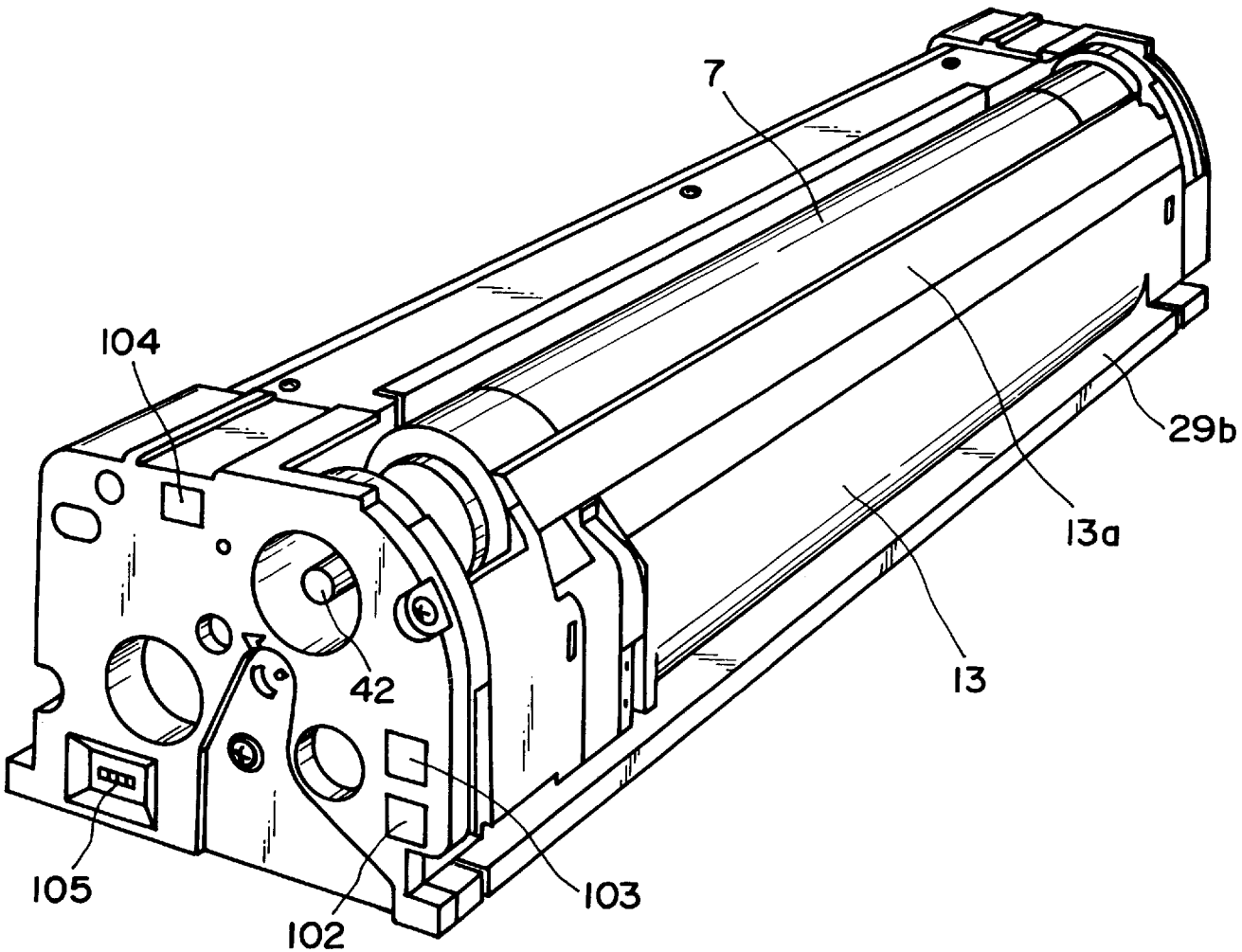
FIG. 10 is a perspective view of the process cartridge placed upside down, as seen from the left rear.

FIGS. 3–7 are projected plans of the process cartridge B (BY, BM, EC and BB): FIG. 3 is a front view; FIG. 4, a right side view; FIG. 5, a left side view; FIG. 6, a top view; and FIG. 7 is a rear view. FIGS. 8–10 are external perspective views of the process cartridge B: FIG. 3 is a view as seen from diagonally above the right front corner; FIG. 9, a view as seen diagonally above the right rear corner; and FIG. 10 is an upside down view as seen from diagonally above the right rear. In FIGS. 3–10, the shutter 18 is not illustrated.

Referring to FIG. 2, the charge unit C comprises the charge unit frame 13, and the charge roller 8*a*, regulator blade 3*c*, and electrically conductive brush 11 which are integrally disposed in the charge unit frame 13. Referring to FIGS. 2, 4, 8, 9 and 10, the charge unit frame 13 constitutes a part of the external shell of the process cartridge B. Referring to FIGS. 2 and 10, the bottom corner wall 13*a* of the charge unit frame 13 extends in the longitudinal direction of the process cartridge B, in parallel to the photosensitive drum 7, holding a small gap from the peripheral surface of the photosensitive drum 7. From this bottom corner wall 13*a*, the wall 13*b* virtually vertically extends upward, and curves inward at the top, forming a corner portion 13*c*. From the inward edge of the corner portion 13*c*, a top wall 13*d* extend virtually horizontally, providing the charging unit frame 13 with an approximately key-shaped cross section There is an empty space under the top wall 13*d*. The charge unit frame 13 is also provided with component attachment portions 13*e* and 13*f*, which are integrally formed with the charge unit frame 13, being located at the longitudinal ends, one for one.

Figure 11:
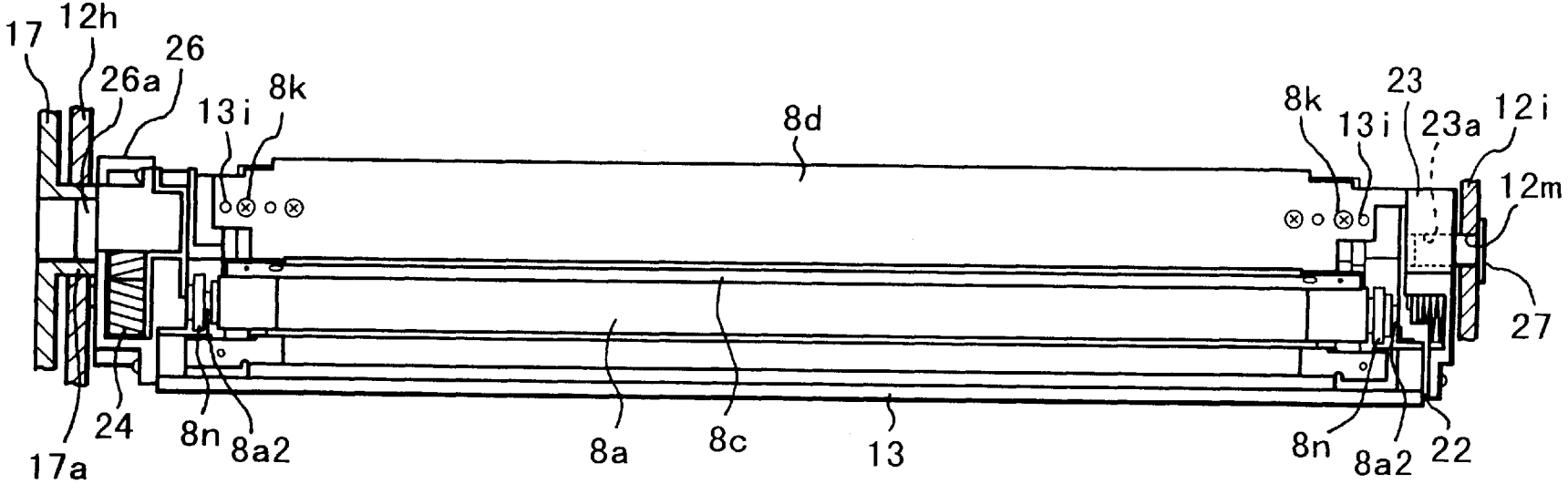
FIG. 11 is a front view of a charging unit.

FIG. 11 is a side view of the charge unit c as seen from inside The charge unit frame 13 is provided with a charge roller bearing 22 and an end cover 23, which are attached to the longitudinal end of the charge unit frame 13, with the use of the screws put through both bearing 22 and cover 23, on the trailing side in terms of the direction in which the process cartridge B is installed in the apparatus main assembly 14 (process cartridge B is installed in the longitudinal direction from the front side of the apparatus main assembly 14). The other longitudinal end of the charge unit C is provided with a gear unit 24, which is fixed to the charge unit frame 13 also with the use of screws.

Figure 12:
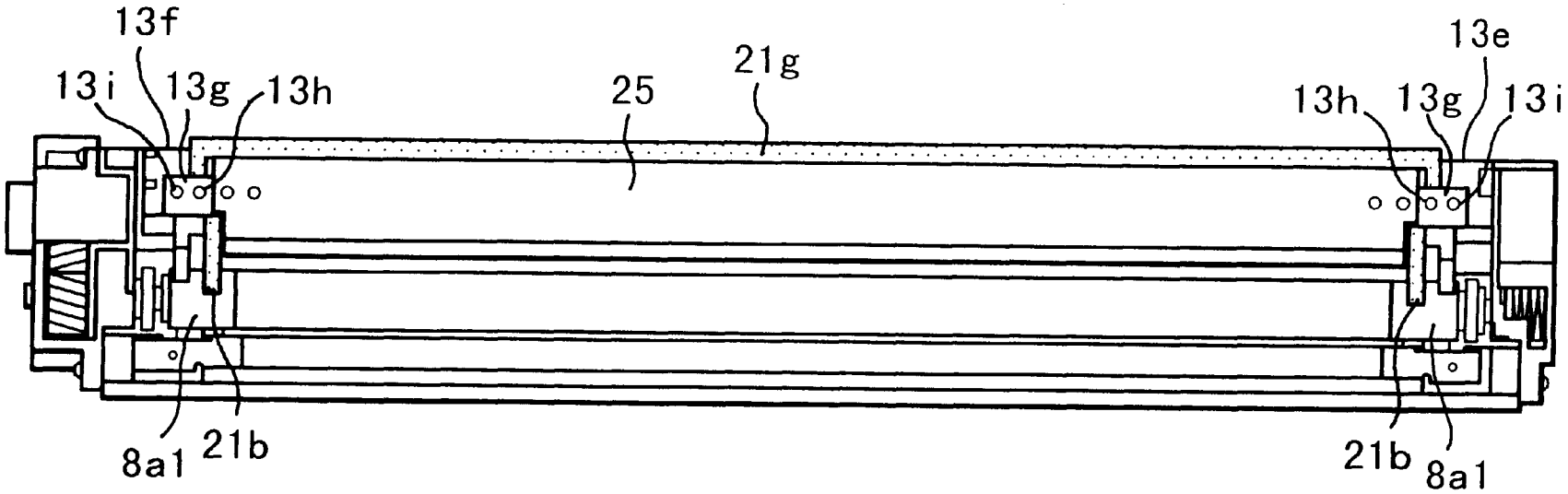
FIG. 12 is a front view of the charging unit illustrated in FIG. 11, with its blade removed.
Figure 13:
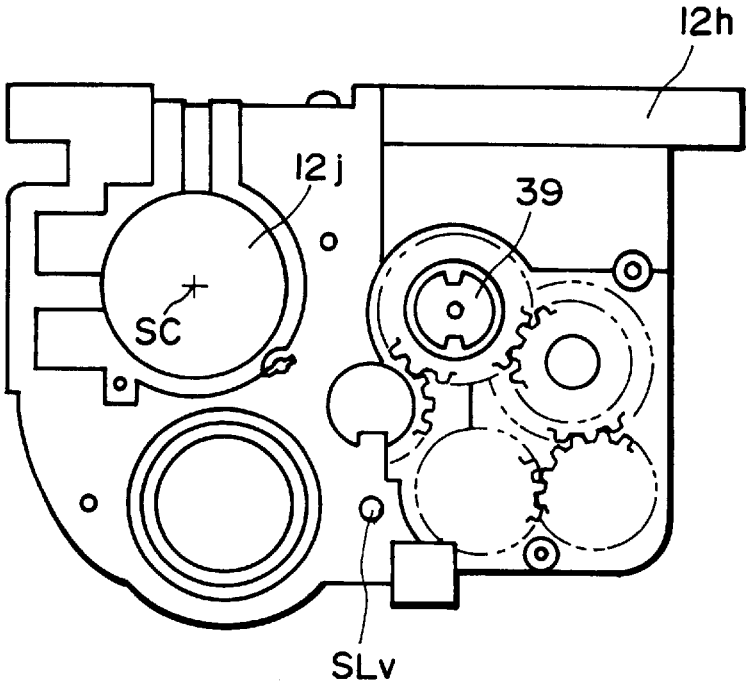
FIG. 13 is a rear view of a development unit, with its rear cover removed.
Figure 14:
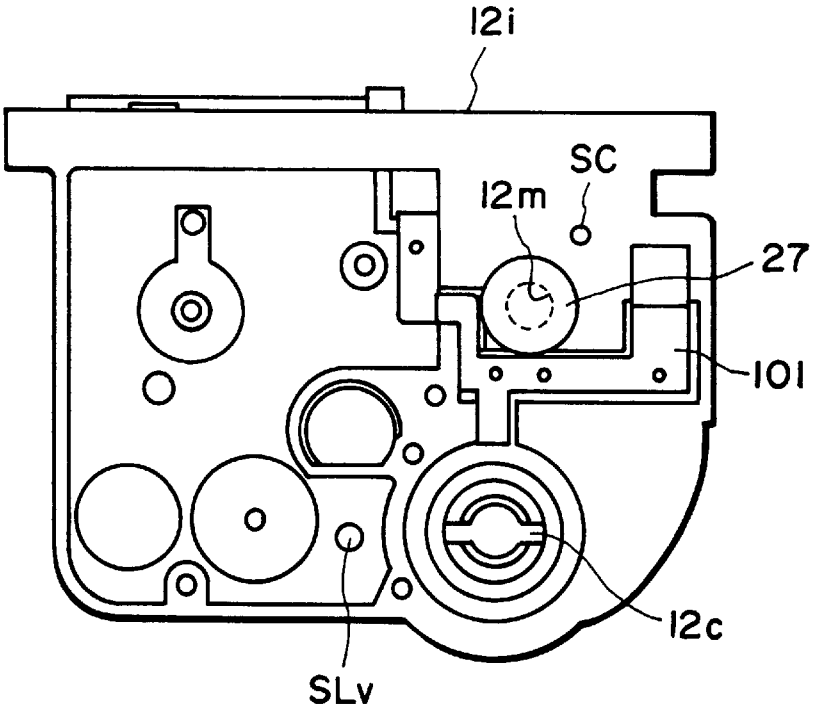
FIG. 14 is a front view of the development unit, with its front cover removed.

Referring to FIG. 12, which is, also a side view of the charging unit C as seen from inside, with the regulator blade 8*c* and a supporting plate 8*d* removed, a pair of blade attachment seats 13*g*, i.e., flat portions, which are slightly raised from the component attachment portions 13*e* and 13*f*, are provided with a female screw 13*h* and a dowel-like projection 13*ia*. The flat portions, slightly recessed from the corresponding seats 13*g*, are covered with a sealing member 21*g*, which is formed of material such as sponge, extends in the longitudinal direction, and is pasted to the flat portion. The charge unit C is also provided with a pair of sealing members 21*b*, which are formed of such material as felt, and are pasted to the longitudinal ends of the charge unit frame 13, one for one, along the internal surface of the semicylindrical sealing portion 8*a*1 located at the longitudinal ends of the charge roller 8*a*, to prevent the developer from leaking out of the process cartridge B along the peripheral surface of the shaft of the charge roller 8*a*. Therefore, the contour of the cross-section of the portion of the charge unit frame 13, perpendicular to the longitudinal direction of the process cartridge B, is in the form of an arc, the focus of which is on the axial lien of the charge roller 8*a*.

Referring to FIG. 2, the regulator blade 8*c*, which is formed of metallic material, is fixed to the metallic supporting plate 8*d* with the use of a small screw 8*j*, holding a small gap from the charge roller 8*a*. The metallic supporting plate 8*d* has a groove-like cross section. It is fitted around the dowel-like projection 13*i* of the seat portion 13*g* of the charge unit frame 13, and as a small screw 8*k* put through the hole of the metallic support plate 8*d* is screwed into the female threaded hole 13*h* of the seal portion 13*g*, the metallic supporting plate 8*d* comes into contact with the seat portion 13*g*, while compressing the sealing member 21*a*. Also during this attachment of the metallic supporting plate 8*d*, the sealing member 21*a* is compressed by the metallic supporting plate 8*a*, across the portion adjacent to the seat portion 13*g*. The metallic supporting plate 8*d* is extremely high in rigidity, and fixing it to the charge unit frame 13 by both longitudinal ends adds to the rigidity of the charge unit frame 13. There is backing member 25 on the back side of the metallic supporting plate 8*d*, which extends from the component attachment portion 13*e* to the component attachment portion 13*f* in the longitudinal direction, and is fixed to the metallic supporting member 8*d* (FIGS. 2 and 12).

(Attachment of Charge Unit)

The charge unit C is supported by the development unit frame 12, being enabled to pivot about a pivotal axis SC illustrated in FIG. 2. Therefore, a gear unit 24 fixed to the charge unit frame 13, at the longitudinal end on the rear side, is provided with a cylindrical shaft portion 26*a*, the position of which corresponds to the position of the aforementioned pivotal axis SC, whereas the end cover 23 at the other longitudinal end of the charge unit frame 13 is provided with a cylindrical hole 23*a*, the position of which corresponds to the position of the pivotal axis SC, as shown in FIG. 11.

Figure 15:
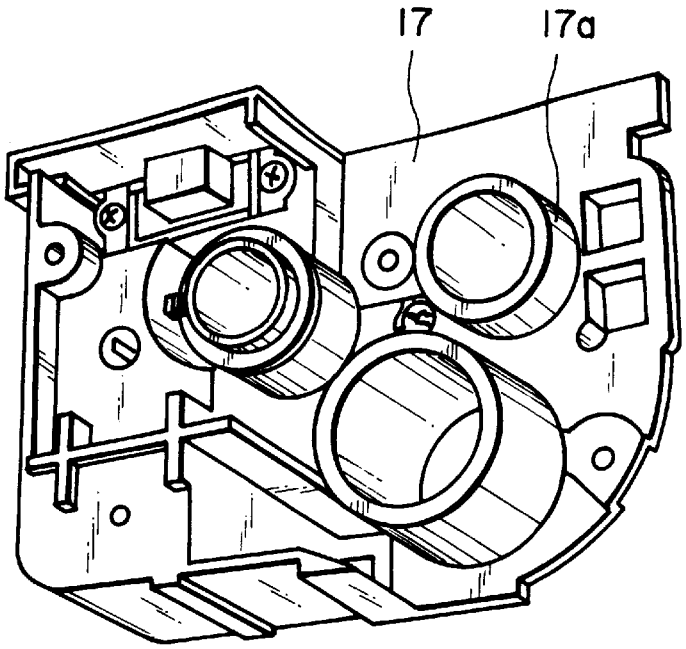
FIG. 15 is a perspective view of the inward side of the rear cover of the development unit.
Figure 16:
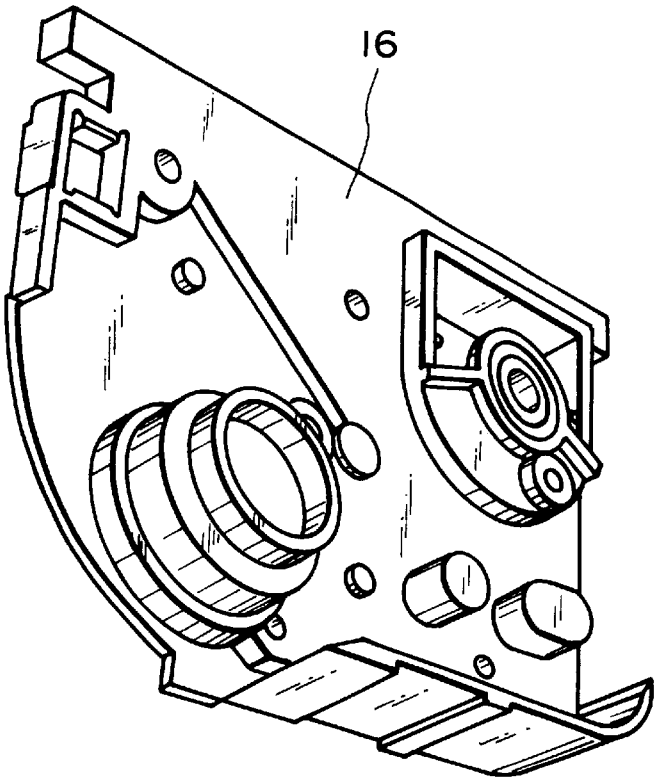
FIG. 16 is a perspective view of the inward side of the front cover of the development unit.

Referring to FIG. 2, the development unit frame 12 comprises a bottom portion 12*f*, a side wall portion 12*g*, an end wall 12*h* (rear), and an end wall 12*i* (front). The bottom portion 12 holds the aforementioned stirring screws log and 10*h* separated by the partitioning wall 10*f*, and has a pair of seat portions 12*e* to which the regulator blade 10*e* is attached. The side wall portion 12*g* constitutes the left side wall of the process cartridge B as seen from the upstream side in terms of the direction in which the process cartridge B is installed. The end walls 12*h* and 12*i* constitute the longitudinal end portions of the process cartridge B as shown in FIGS. 13, 14, 17 and 18. The end wall portion 12*h* is provided with a hole 12*j*, in which a bearing is fitted to rotatively support the aforementioned cylindrical shaft portion 26*a* of the charge unit C. The end wall portion 12*i* is provided with a hole 12*m*, the diameter of which is the same as that of the cylindrical hole 23*a* of the charge unit frame 13. When joining the charge unit C with the development unit frame 12, the cylindrical hole 23 of the charge unit C is aligned with the hole 12*m* of the end wall portion 12*i* of the development unit frame 12, with the cylindrical shaft portion 26*a* of the charge unit C being inserted in the hole 12*j* of the end wall portion 12*h* of the development unit frame 12. Next, the rear cover 17, that is, the cover on the leading side in terms of the direction in which the process cartridge B is installed, is aligned with the longitudinal end portion of the development unit frame 12 so that a shaft supporting portion 17*a* in the form of a hollow cylinder projecting in the longitudinal direction, in the space within the rear cover 17 (FIGS. 11 and 15), fits in the hole 12*j* of the development unit frame 12, and the cylindrical shaft portion 26*a* fits into the cylindrical hollow of the shaft supporting portion 17*a*. On the front side, a supporting shaft 27 (FIGS. 11 and 14) is put through the hole 12*m* of the end wall portion 12*i* of the development unit frame 12, so as to project inward from the hole 12*m*, and fit into the hole 23*a* of the charge unit C. As a result, the charge unit C is pivotally supported by the development unit frame 12; the cylindrical shaft portion 26*a*, that is, one of the longitudinal end portions, of the charge unit C is rotatively supported by the end cover 17, and the wall of the hole 23*a* of the charge unit C, on the other longitudinal end, is supported by the supporting shaft 27.

Referring to FIGS. 6 and 8, on the top side of the development unit frame 12, the top wall 29 is fixed to the development unit frame 12 with the use of small screws 28, so that the edges of the top wall 29 fit with the guide portion 12*a*, that is, the top portion of the side wall 12*g*, and the end walls 12*h* and 12*i*, on the inward side.

Referring to FIG. 2, the top wall 29 is provided with a pair of spring seats 29*a* which are aligned in the longitudinal direction, and each of which holds a compression spring 30, so that the spring 30 is kept compressed between the top wall 29 and charge unit frame 13. The charge unit C is kept under the pressure generated by these coil springs 30 in the direction to pivot the charge unit C about the pivotal axis SC in the clockwise direction.

Referring to FIG. 11, each longitudinal end of the charge roller 8*a* is provided with a journal portion 8*a*2, which is smaller in diameter than the main portion of the charge roller, is coaxial therewith, and is fitted with a freely rotating spacer ring 8*n*. The spacer ring 8*n* is kept in contact with the peripheral surface of the photosensitive drum 7, on the portion outside the image formation range, by the resiliency of the aforementioned compression springs 30. With the provision of the above structure, a gap is provided between the peripheral surfaces of the photosensitive drum 7 and charge roller 8*a*. Further, the charge roller 8*a* and photosensitive drum 7 are rotated in such directions so that the movements of their peripheral surfaces become opposite to each other where the gap between them is smallest, and the transfer-residual toner which enters where the distance between the peripheral surfaces of the charge roller 8*a* and photosensitive drum 7 is smallest is caught by the application or charge bias.

Regarding the above described structure, the line connecting the pivotal axis SC and the center of the charge roller 8*a* in virtually perpendicular to the line connecting the centers of the charge roller 8*a* and photosensitive drum 7

Figure 17:
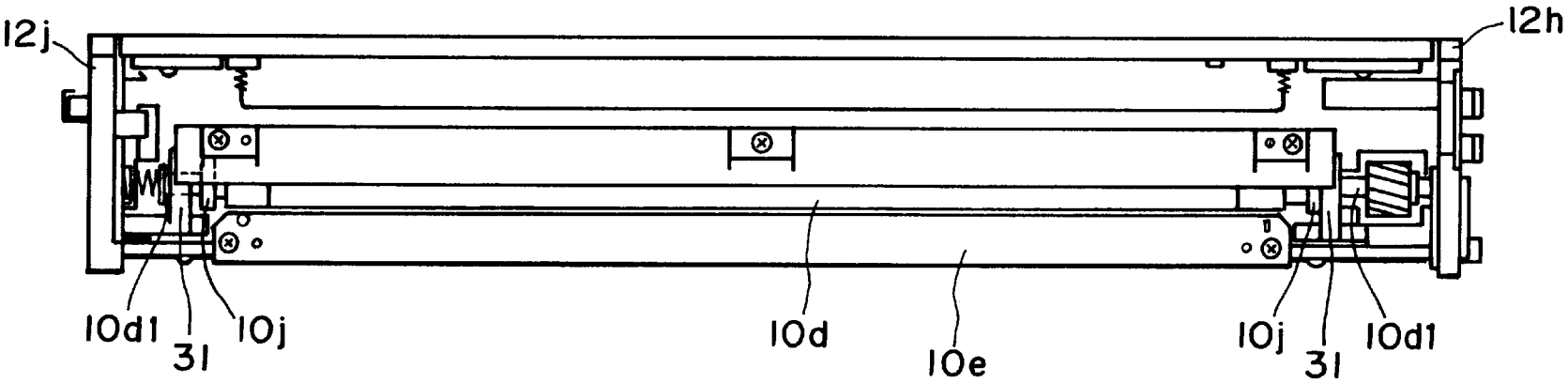
FIG. 17 is a side view of the development unit.

Referring to FIG. 2, the development sleeve 10*d* is attached to the development unit frame 12 so that it is allowed to pivot about the pressure application point Slv, to move toward, or away, from the development unit frame 12. Referring to FIG. 17, each longitudinal end of the development sleeve 10*d* is provided with a journal portion 10*d*1, which is smaller in diameter than the main portion of the development sleeve 10*d*, and is fitted with a spacer ring 10*j* greater in radius by an amount equal to the development gap than the main portion. The journal 10*d*1 is also fitted with a pivotal arm 32, which is on the outward side of the spacer ring 10*j*.

Figure 18:
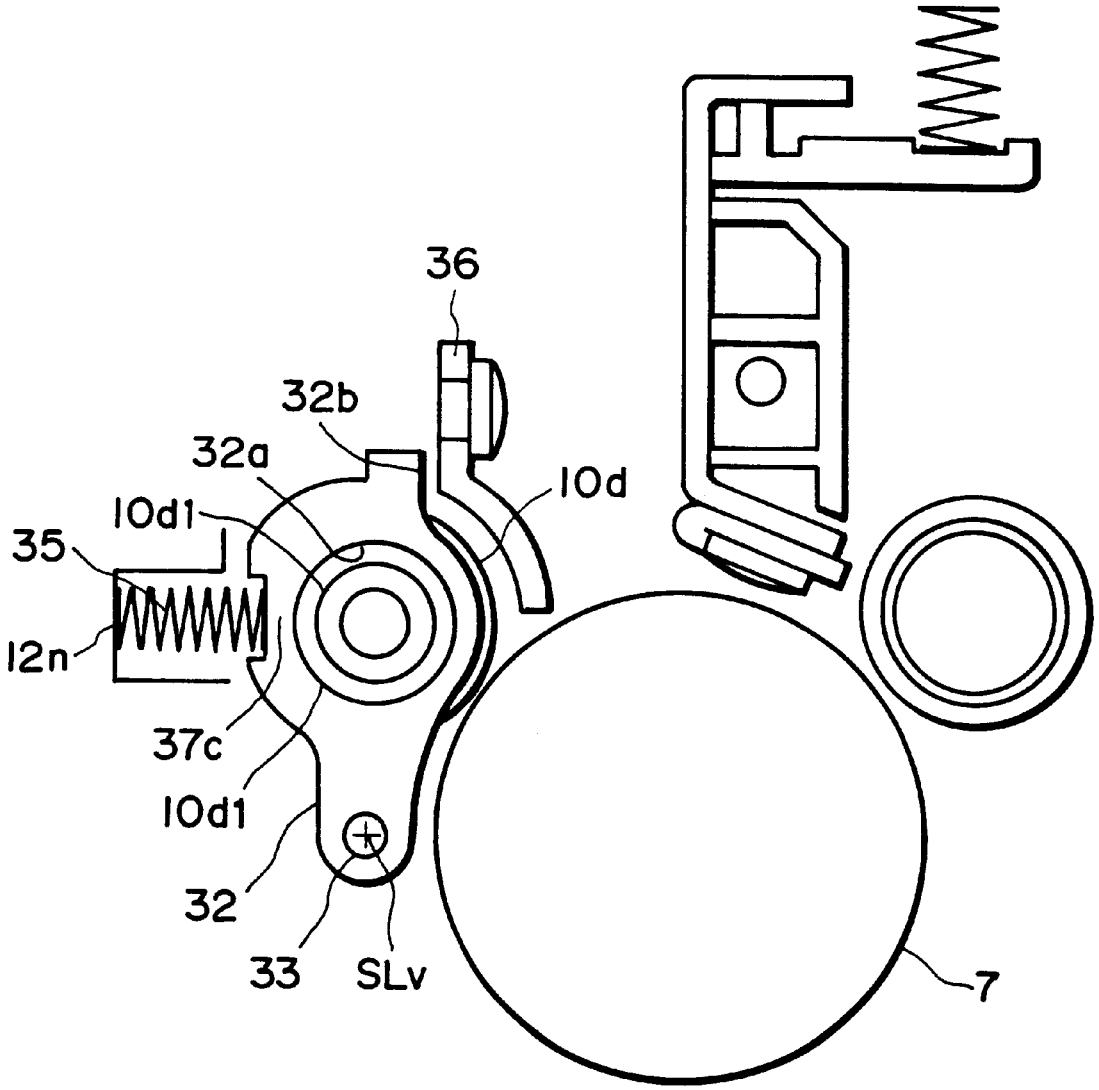
FIG. 18 is a front view of the supporting portion for a development sleeve.

Referring to FIG. 18, which is a sectional view of the pivotal arm 32 and its adjacencies, at a plane perpendicular to the development sleeve 10*d*, the base portion of the pivotal arm 32 is pivotally supported by a supporting axis 33 (pivot axis) put through the development unit frame 12 in the longitudinal direction and press-fitted in both end walls 12*h* and 12*i* of the development unit frame 12. The pivotal arm 32 is provided with a bearing hole, which is located approximately straight above the supporting shaft 33, and a stopper portion 32*b*, which is located above the bearing hole 32*a*. The pivotal arm 32 is also provided with a spring seat 37*c*, the surface of which is approximately perpendicular to the line connecting the pressure application center Slv, i.e., the center of the supporting shaft 33, and the center of the bearing hole 32*a*.

The journal portion 10*d*1 located at each longitudinal end of the development sleeve 10*d* is rotatively supported in the bearing hole 32*a* of the pivotal arm 32. Between the spring seat 32*c*, and the spring seat 12*n* with which the end wall 12*h* (12*i*) of the development unit frame 12, the compression spring 35 is placed in the compressed state. With this arrangements the pivotal arm 32 is kept under the pressure generated by the compressing spring 35 in the direction to pivot the pivotal arm 32 about the pressure application center Slv (center of the supporting shaft 33) toward the photosensitive drum 7, which in turn keeps the spacer rings 10*j*, fitted around the development sleeve 10*d*, in contact with the peripheral surface of the photosensitive drum 7, on the portion outside the image formation range. As a result, a predetermined gap (0.2–10 mm) is maintained between the peripheral surface of the development sleeve 10*d* and photosensitive drum 7.

The aforementioned stopper portion 32*b* prevents the pivotal arm 32 from pivoting outward (FIG. 18) of the development unit frame 12, by coming into contact with the development sleeve cover 36, when assembling or disassembling the process cartridge B. Thus, after the completion of the assembly of the process cartridge X, the stopper portion 32*b* is not in contact with the development sleeve cover 36. The development sleeve cover 36 extends from the pivotal arm 32 on the front side to the one on the rear side, and is fixed to the development unit frame 12 with screws.

(Structure for Installing Process Cartridge into Main Assembly of Image Forming Apparatus, or Removing it Therefrom)

Referring to some of the appended drawings, for example, FIGS. 3 and 7, the top portion of the process cartridge B is provided with guiding portions 12*a* and 29*b* in the form of a flange, which extend along the left and right sides, respectively, as seen from the trailing side in terms of the process cartridge B installation. These guiding portions 12*a* and 29*b* engage with corresponding unillustrated guide rails which extend perpendicular to the plane of FIG. 1, when the process cartridge B is installed into or removed from, the main assembly of the image forming apparatus.

The process cartridge B is provided with electrical contacts, which come into contact with the correspondent electrical contacts on the apparatus main assembly side which are connected to an unillustrated high voltage power source provided on the apparatus main assembly side, as the process cartridge B is installed into the apparatus main assembly 14.

More specifically, referring to FIGS. 3 and 8, the process cartridge B is provided with a drum ground contact 101, which is on the trailing side in terms of the direction in which the process cartridge B is installed, and is connected to photosensitive drum 7. Referring to FIGS. 7, 9 and 10, the process cartridge E is provided with a contact 102 for the electrically conductive brush, which is connected to the electrically conductive brush 11, a charge bias contact 103 which is connected to the charge roller 8*a*, and a development bias contact 104 which is connected to the development sleeve 10*d*. The contacts 102, 103 and 104 are on the rear side, i.e., the leading side in terms of the direction in which the process cartridge d is installed. The process cartridge B is also provided with an I.C. equipped connector 105, which is on the rear side, that is, the same side as the contacts 102, 103 and 104. The connector 105 is connected with the unillustrated connector on the apparatus main assembly side as the process cartridge B is installed into the apparatus Main assembly 14, so that the controlling apparatus on the apparatus main assembly side is allowed to write the usage history of the installed process cartridge B into the I.C. equipped connector 105, or to read it therefrom, to control the image forming operation.

The process cartridge B is provided with three driving power receiving portions in the form of a coupler, the rotational axes of which coincide with the rotational axes of the corresponding components. They are located on the rear side, that is, the leading end side in terms of the direction in which the process cartridge B is installed. As the process cartridge B is installed into the apparatus main assembly 14, the three driving force receiving portions are connected with the corresponding driving force transmitting embers of the apparatus main assembly 14.

More specifically, referring to FIG. 7, the rear side of the process cartridge is provided with a drum coupling 37*d*, a charging portion coupling 38, and a development portion coupling 39, which are exposed from the rear wall of the process cartridge B.

(Means for Supporting and Driving Photosensitive Drum)

The drum coupling 37*d* is provided at the longitudinal end of the drum flange 37 fixed to the longitudinal ends of the photosensitive drum 7.

Figure 19:
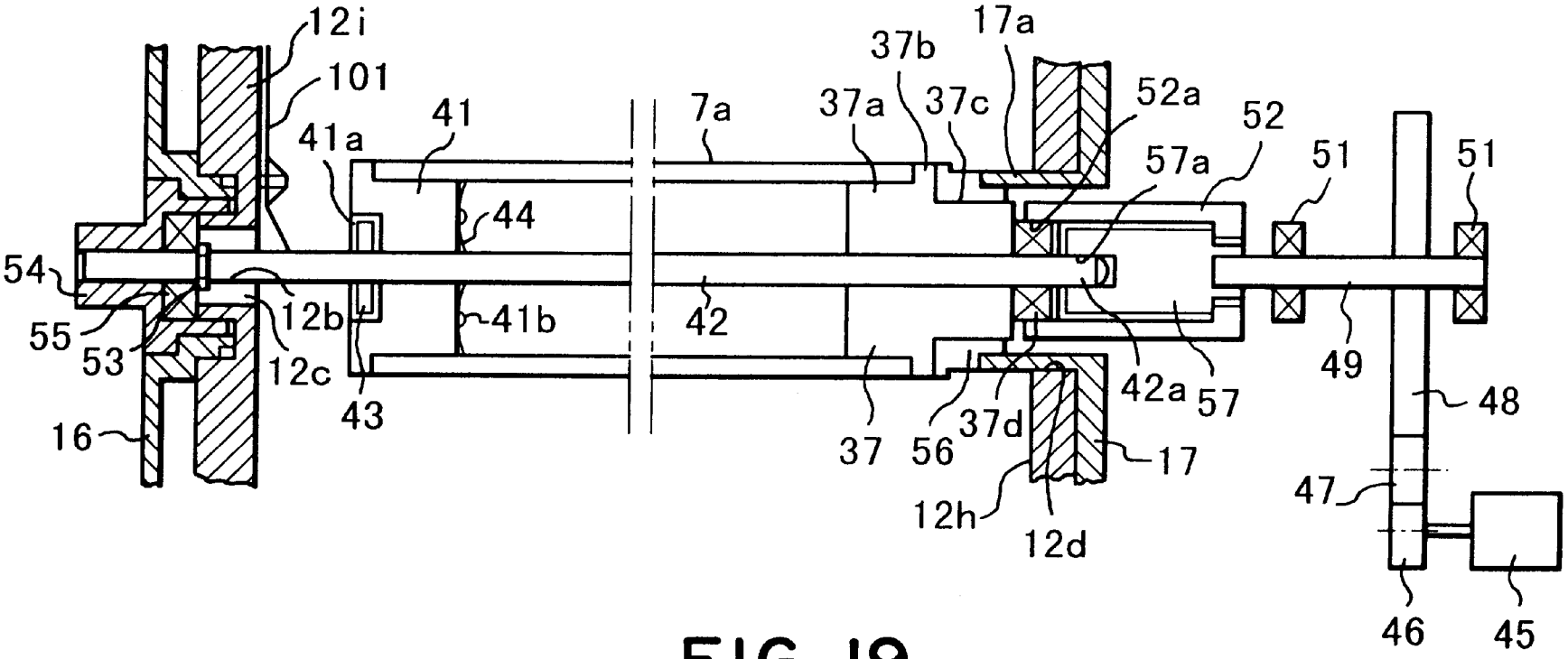
FIG. 19 is a vertical sectional view of the supporting portion for the electrophotographic photosensitive drum, and a driving apparatus for the electrophotographic photosensitive drum.

FIG. 19 depicts a method for supporting the photosensitive drum 7, and a method for driving the photosensitive drum 7. The photosensitive drum 7 comprises a hollow aluminum cylinder 7*a*, and a layer of photosensitive substrate coated an the peripheral surface of the aluminum cylinder 7*a*. The photosensitive drum 7 is provided with a pair of drum flanges 37 and 41, which are filed to the longitudinal ends of the photosensitive drum 7, on the driven and non-driven sides, respectively, by pressing their smaller diameter portions into the aluminum cylinder 7*a*. The drum shaft 42 is put through the centers of the drum flanges 37 and 41. One end of the drum shaft 42 is fitted through a through hole 12*b* with which the end wall portion 12*i* of the development unit frame 12 is provided. A pin 43 is pressed through a through hole made in the drum shaft 42, in the radial direction, and is exactly fitted in a straight groove which is located in the outwardly facing surface of the drum flange 41 on the non-driven side, and extends outward in both directions from the center of drum flange 41 on the non-driven side. In order to establish electrical connection between the drum shaft 42 and drum cylinder 7*a*, the drum flange 41 on the non-driven side is provided with an electrically conductive spring 44, which is fixed to the inwardly facing surface of the drum flange 41. As for the method by which the electrically conductive spring 44 is fixed to the drum flange 41, the electrically conductive spring 44 is fitted around the dowel-like projection 41*b* with which the drum flange 41 is provided, and then, the dowel-like projection 41*b* is melted and solidified. One end of the electrically conductive spring 44 remains in contact with the inward surface of the drum cylinder 7*a* because of the resiliency of the spring 44, and the other end of the spring 44 remains in contact with the drum shaft 42 also because of the resiliency of the spring 44.

One end of the drum grounding contact 101 attached to the end wall portion 12*i* of the development unit frame 12 remains in contact with the drum shaft 42 because of the resiliency of the contact 101. The other end of this drum grounding contact 101 with which the development unit frame 12 is provided is exposed from the process cartridge B, and serves as an external contact.

The end wail portion 12*i* is provided with a straight groove 12*c*, which radially extends from the drum shaft supporting through hole 12*b* in both directions, so that the pin 43 can be put through the end wall portion 12*i* in the axial direction of the photosensitive drum 7 during the assembly of the process cartridge B.

The drum flange 37 on the driven side comprises an attachment portion 37*a* which fits into the drum cylinder 7*a*, a rib portion 37*b* which comes into contact with the longitudinal end of the drum cylinder 37*a*, a journal portion 37*c* with a diameter smaller than that of the rib portion 37*b*, and male coupler portion 37*d* which projects in the axial direction of the photosensitive drum 7 from the center portion of the outward surface of the journal portion 37*c*, in the listed order from the inward side. The drum flange 37 on the driven side is a molded single piece component.

The journal portion 37*c* is rotatively fitted in the'shaft supporting portion 17*a* which is an integral part of the rear cover 17 inserted into the hole 12*d* of the end wall portion 12*h* of the development unit frame 12, with the interposition of a collar 56 between the journal portion 37*c* and shaft supporting portion 17*a*.

Figure 20:
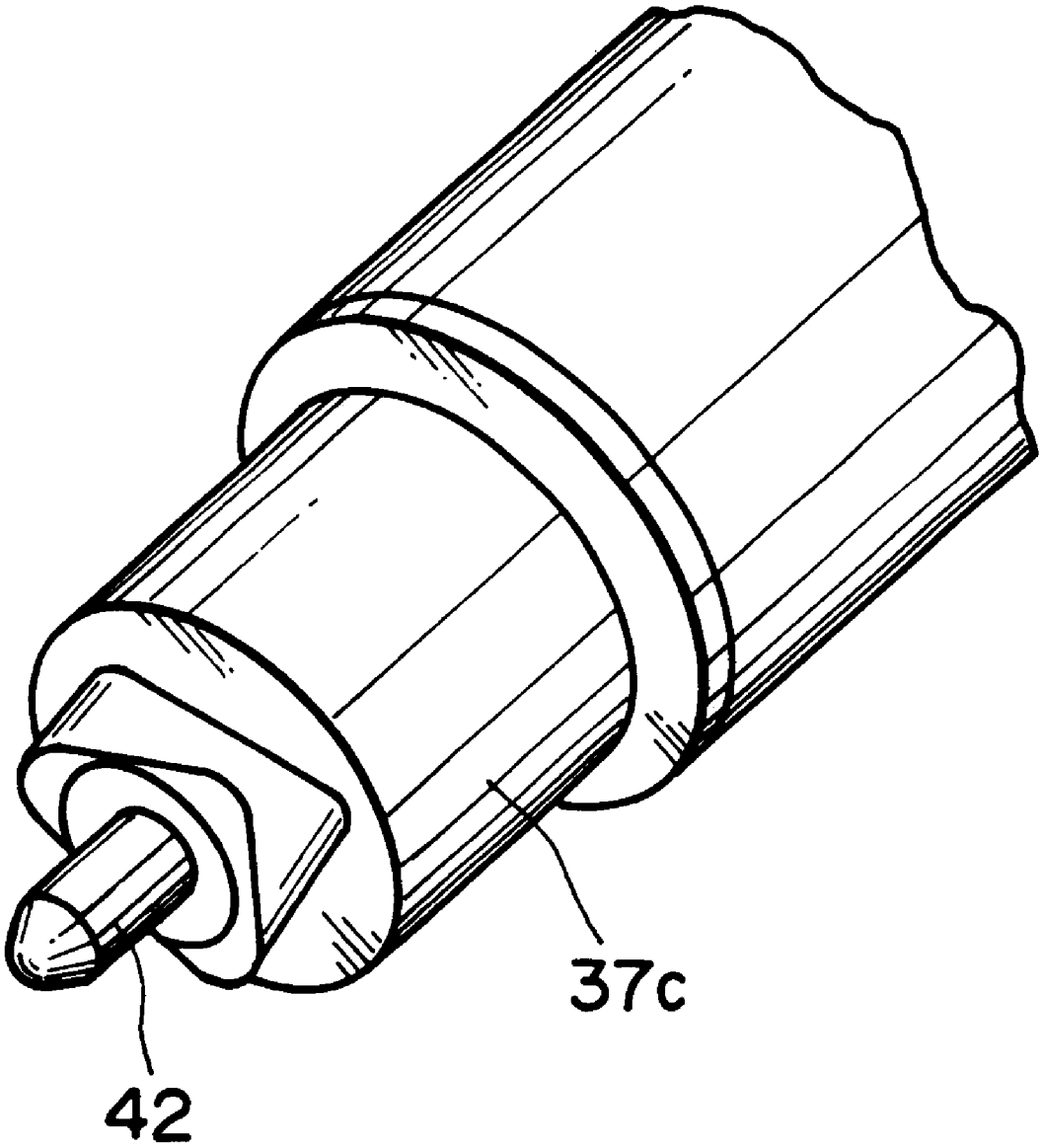
FIG. 20 is a Perspective view of the drum flange on the driven side.

Referring to FIG. 20, the male coupler portion 37*d* is in the form of a twisted equilateral triangular prism. The diameter of the circumcircle of this male coupler portion 37*d* is smaller than that of the journal portion 37*c*.

The driving apparatus with which the apparatus main assembly 14 is provided comprises a motor 45 anchored to the apparatus main assembly, a pinion gear 46, an intermediary gear 47, a large gear 48, a shaft 49 for the large gear 48, a bearing 51 for supporting the shaft 49 for the large gear 48, and a female coupler shaft 52. The intermediary gear 47 is meshed with the pinion gear 46 and large gear 48, and is rotatively supported. The shaft 49 for the large gear 48 is fixed to the large gear 48, and is provided with an axis aligning portion 57, which is press fitted with the inward end of the shaft 49.

The beating 51 supports the shaft 49 for the large gear 48 so that the latter does not move in the axial direction. The female coupler portion 52*a* is provided with a hole in the form of a twisted equilateral triangular prism, into, or from, which the male coupler portion 37*d* is engaged or disengaged in the axial direction. When the male coupler portion 37*d* engages into the female coupler portion 52*b*, the longitudinal edges of the male coupler portion 37*d* in the form of an equilateral triangular prism make contact with the correspondent surfaces of the hole of the female coupler portion 52*a*, in the form of an equilateral triangular prism. As a result, the rotational axis of the male coupler portion 37*d* becomes aligned with the rotational axis of the female coupler portion 52*a*. There is provided a microscopic gap between the peripheral surface of the axis aligning portion 57 and the inward surface of the female coupler portion, in terms of the radial direction, so that microscopic movement in the radial direction is afforded for the axis aligning portion 57. The female coupler shaft 52 is kept under the pressure generated by a spring in the direction to move the shaft 52 toward the process cartridge B, and therefore, it remains at the innermost position within the range in which it is allowed to move in the axial direction, although it is enabled to be moved outward against the resiliency of the spring (details are omitted).

The portion of the drum shaft 42, by which the drum shaft 42 is supported on the non-driven side, is structured so that the drum shaft 42 does not move toward the non-driven side. More specifically, the drum shaft 42 is fitted with a stopper ring 53 as shown in the drawing. A gearing 55 fitted in a gearing case 54 fixed to the front cover 16 fixed to the end wall portion 12*i* of the development unit frame 12 is fitted around the drum shaft 42, and the drum shaft 42 is prevented from moving toward the non-driven side as the outward surface of the shaft stopper ring 53 comes into contact with the inward surface of the bearing case 54, in terms of the axial direction. In comparison, the movement of the photosensitive drum 7 toward the driven side is controlled by the collar 56 fitted around the journal portion 37*c* of the drum flange 37. Regarding the above described structure, the distance between the shaft supporting portion 17*a* and bearing 55 is rendered larger than the distance between the surface of the shaft stopper ring 53, which faces the bearing 55, and the surface of the Collar 56, which faces the shaft supporting portion 17*a*, so that the photosensitive drum 7 is allowed to move a limited distance in the axial direction.

Since the driving apparatus is structured as described above, as the process cartridge B is installed into the image forming apparatus main assembly 14, the cartridge frame (development unit frame 12, front dover 16, and rear cover 17) is precisely positioned relative to the apparatus main assembly 14 in terms of the longitudinal direction. Further, the end portion 42*a* of the drum shaft 42 fits into the center hole 57*a* of the axis aligning portion 57, and the male coupler portion 37*d* fits into the female coupler portion 52*a*. Then, as the motor rotates, the pinion gear 46, intermediary gear 47, and large gear 48 rotate, causing the female coupler shaft 52 to rotate through the gear shaft 49 for the large gear 48, and the axis aligning portion 57. With this rotation of the female coupler shaft 52, the end portion of the male coupler portion 37*d* comes into contact with the bottom surface of the female coupler portion 52*a*, because the male and female coupler portions 37*d* and 52*a* are both in the form of a twisted triangular prism, and the directions of their twist are such that the male coupler portion 37*d* is enabled to be screwed into the female coupler portion 52*a* As a result, the photosensitive drum 7 is accurately positioned in the axial direction relative to the accurately positioned female coupler shaft 52.

When the male coupler portion 37*d* does not engage with the female coupler portion 52*b* immediately after the installation of the process cartridge B into the apparatus main assembly 14, the inward surface of the male coupler portion 37*d* presses upon the edge of the female coupler portion (hole) 52*a* of the female coupler shaft 52, and therefore, the female coupler shaft 52 is caused to move away from the process cartridge B against the resiliency of the spring which presses the female coupler shaft 53 toward the process cartridge B. However, the male coupler portion 37*d* and female coupler portion 52*a* instantly engage with each other the moment they synchronize in rotational phase. The above structure may be modified so that, as the photosensitive drum 7 is pulled toward the female coupler shaft 52 by the force generated by the rotational engagement between the two coupler portions, the photosensitive drum 7 is correctly positioned by the contact between the collar 56 fitted around the journal portion 37*c* of the drum flange 37, in contact with the rib 37*b*, and the shaft supporting portion 17*a* of the rear cover 17, instead of the contact between the inward surface of the male coupler portion 35*d* and the bottom surface of the female coupler portion (hole) 52*a*.

Although this embodiment was described with reference to a process cartridge which integrally comprises a developing means, and a charging means capable of recovering toner, along with a photosensitive drum. However, the structural configuration in this embodiment, that is, the structural configuration for supporting a photosensitive drum with the cartridge frame, and the structural configuration for engaging the driving force receiving portion of the photosensitive drum with the driving member on the image forming apparatus main assembly side, or disengaging them, are also applicable to most process cartridges.

The process cartridge mentioned in this specification means a cartridge which integrally comprises a charging means, a developing means or cleaning means, and an electrophotographic photosensitive drum, and is removably installable into the main assembly of an image forming apparatus, a cartridge which integrally comprises at least a charging means, a developing means, or a cleaning means, in addition to an electrophotographic photosensitive drum, and is removably installable into the main assembly of an image forming apparatus, or a cartridge which integrally comprises at least a developing means and an electrophotographic photosensitive drum, and is removably installable into the main assembly of an image forming apparatus.

The embodiment of the present invention are summarized as follows:

1. A process cartridge B detachably mountable to a main assembly 14 of an image forming apparatus, comprising:

an electrophotographic photosensitive drum 7 having a coupling member 37*d* at one end thereof, wherein said process cartridge is detachably mountable in a direction of an axis of said electrophotographic photosensitive drum:

process means actable on said electrophotographic photosensitive drum;

a projected shaft 42 projected from said coupling member of said electrophotographic photosensitive drum, said projected shaft being engageable with a hole of an engaging member provided in the main assembly.

2. A process cartridge according to item 1, wherein said projected shaft penetrates said electrophotographic photosensitive drum at a center of said electrophotographic photosensitive drum and is projected out of the opposite ends of said electrophotographic photosensitive drum.

3. A process cartridge B detachably mountable to a main assembly 14 of an image forming apparatus, comprising:

an electrophotographic photosensitive drum 7;

process means actable on said electrophotographic photosensitive drum;

a cartridge frame 12 for supporting said process means and for rotatably supporting such one end of said electrophotographic photosensitive drum as is provided with a coupling member 37*d* engagable with an engaging member 52*a* provided in the main assembly of said image forming apparatus;

a drum shaft 42 penetrating said electrophotographic photosensitive drum at a center thereof and projects out of opposite ends of said electrophotographic photosensitive drum, said drum shaft being rotatably supported on said cartridge frame adjacent the other end of said electrophotographic photosensitive drum, and being engageable with a hole 57*a* of an engaging member 52*a* of a driving member 52 provided in the main assembly adjacent the other end of said electrophotographic photosensitive drum.

4. A process cartridge B detachably mountable to a main assembly 14 of an image forming apparatus, comprising:

an electrophotographic photosensitive drum 7 having a photosensitive layer at an outer circumference thereof;

process means actable on said electrophotographic photosensitive drum;

a cartridge frame 12 supporting said electrophotographic photosensitive drum and said process means;

a driving side flange 37 fixed to one end of said drum and having a journal portion 37*c* supported rotatably on said cartridge frame and a driven side coupling;

a flange 41 fixed to the other non-driving end of said drum; and a drum shaft 42 penetrating said drum at a center of the flanges 37, 41 to support them and projected out of opposite ends of the flanges, a portion of said drum shaft at the non-driving end is rotatably supported on said cartridge frame, and a portion of said drum shaft at the driving end is engageable with a central hole 57*a* of a driving member provided in the main assembly of the image forming apparatus.

5. A process cartridge according to any one of Items 1–4, wherein said process cartridge contains the electrophotographic photosensitive drum and charging means 8, developing means 10 or cleaning means as a unit, and said process cartridge is detachably mountable to the main assembly 14 of the image forming apparatus as a unit.

6. A process cartridge according to any one of Items 1–4, wherein said process cartridge contains the electrophotographic photosensitive drum and and at least one of charging means 8, developing means 10 and cleaning means as a unit, and said process cartridge is detachably mountable to the main assembly of the image forming apparatus as a unit.

7. A process cartridge according to any one of Items 1–4, wherein said process cartridge contains at least said developing means 10 and said electrophotographic photosensitive drum 7 as a unit, and said process cartridge is detachably mountable to the main assembly 14 of the image forming apparatus as a unit.

8. A process cartridge B detachably mountable to a main assembly of an image forming apparatus, comprising:

a developing unit D including an electrophotographic photosensitive drum 7, developing means 10 for developing an electrostatic latent image formed on said electrophotographic photosensitive drum with a developer and a frame 12 supporting said electrophotographic photosensitive drum and said developing means;

a frame 13 engageable with and disengagable from said frame supporting said developing means and supporting charging means 8 for charging said electrophotographic photosensitive drum;

wherein said electrophotographic photosensitive drum has flanges 37, 41 fixed thereto at the opposite ends thereof, and said electrophotographic photosensitive drum is rotatably supported on said frame supporting said developing means at one of said drum flange having a coupling 37*d* fixed at one end thereof, and said electrophotographic photosensitive drum is rotatably supported on a frame 12 supporting said developing means by a drum shaft 42 penetrating said flanges at the other end.

9. A process cartridge according to Item 3, wherein said drum shaft is projected out of the coupling so that when the coupling of said drum flange is engaged with or disengaged from a hole 57*a* of an engaging member 57 provided in the main assembly of said image forming apparatus, said drum shaft is engaged in or disengaged from the hole formed at a center of the engaging member.

10. A process cartridge B detachably mountable to a main assembly 14 of an image forming apparatus comprising:

an electrophotographic photosensitive drum 7;

process means actable on said electrophotographic photosensitive drum;

a cartridge frame 12 rotatably supporting a flange 37 fixed to one end of said electrophotographic photosensitive drum and having a coupling 37*d* and rotatably supporting a drum shaft 42 penetrating a flange 41 fixed to the other end of electrophotographic photosensitive drum; and a rotation preventing member provided on said drum shaft 42 and projected in a radial and outward direction of said and said flange 41 fixed to the other end said electrophotographic photosensitive drum;

said said cartridge frame 12 being provided with a hole formed therein for rotatably supporting the drum shaft and having a groove 12*c* which said rotation preventing member penetrates.

11. An electrophotographic image forming apparatus, for forming an image on a recording material, to which a process cartridge B is detachably mountable, comprising:

(a) mounting means for detachably mounting said process cartridge, said process cartridge including;

an electrophotographic photosensitive drum 7 having a coupling member 37*d* at one end thereof, wherein said process cartridge is detachably mountable in a direction of an axis of said electrophotographic photosensitive drum;

process means actable on said electrophotographic photosensitive drum, a projected shaft 42 projected from said coupling member of said electrophotographic photosensitive drum;

(b) an engaging member 57 having a hole 57*a* engageable with said projected shaft 42;

(c) feeding means for feeding the recording material.

12. An electrophotographic image forming apparatus for forming an image on a recording material 2, to which a process cartridge B is detachably mountable, comprising:

(a) mounting means for detachably mounting said process cartridge, said process cartridge including;

an electrophotographic photosensitive drum 7 having a coupling member at one end thereof, wherein said process cartridge is detachably mountable in a direction of an axis of said electrophotographic photosensitive drum;

process means actable on said electrophotographic photosensitive drum;

a cartridge frame 12 for supporting said process means and for rotatably supporting such one end of said electrophotographic photosensitive drum as is provided with a coupling member 37*d* engageable with a hole 57*a* of an engaging member 57 provided in the main assembly of said image forming apparatus;

a drum shaft 42 penetrating said electrophotographic photosensitive drum at a center thereof and projects out of opposite ends of said electrophotographic photosensitive drum, said drum shaft being rotatably supported on said cartridge frame adjacent the other end of said electrophotographic photosensitive drum, said drum shaft being rotatably supported on said cartridge frame adjacent the other end of said electrophotographic photosensitive drum;

(b) a driving member 52 having an engaging member with a hole 52*a*, said drum shaft being engageable with the hole adjacent said one end of said electrophotographic photosensitive drum; and (c) feeding means for feeding the recording material.

13. An electrophotographic image forming apparatus, for forming an image on a recording material, to which a process cartridge B is detachably mountable, comprising:

(a) mounting means for detachably mounting said process cartridge, said process cartridge including;

a developing unit D including an electrophotographic photosensitive drum 7, developing means 10 for developing an electrostatic latent image formed on said electrophotographic photosensitive drum with a developer and a frame 12 supporting said developing means;

a frame 13 engageable with and disengageable from said frame supporting said developing means and supporting charging means 8 for charging said electrophotographic photosensitive drum;

wherein said electrophotographic photosensitive drum has flanges 37, 41 fixed thereto at the opposite ends thereof, and said electrophotographic photosensitive drum is rotatably supported on said frame supporting said developing means at one of said drum flange having a coupling 37*d* fixed at one end thereof, and said electrophotographic photosensitive drum is rotatably supported on a frame 12 supporting said developing means by a drum shaft 42 penetrating said flanges at the other end;

(b) an engaging member having a hole 52*a*, said drum shaft being engageable with the hole adjacent said one end of said electrophotographic photosensitive drum; and (c) feeding means for feeding the recording material 2.

14. An electrophotographic photosensitive drum 7 usable with a process cartridge B which is detachably mountable to a main assembly 14 of an image forming apparatus, said electrophotographic photosensitive drum comprising:

a drum member 7*a* having a photosensitive layer on the outer circumferential surface thereof;

a driving side flange 37 fixed to one end of the drum member and having a journal portion 37*c* rotatably supported on said process cartridge and having a driven coupling 37*d;* a flange 41 fixed to the other end; and a drum shaft 42 penetrating centers of said flanges 37, 41 and said drum member to support said flanges and projected out at the opposite ends, wherein a projected portion of said drum shaft adjacent a driven side is portion of said drum shaft of a driving member 52 provided in the main assembly 14.

According to the foregoing embodiment, the drum shaft penetrates an electrophotographic photosensitive drum to project out of the opposite ends thereof, and it is rotatably supported on a cartridge frame at one end, and is engageable with and disengageable from a central hole of a centering membering at the other end so that centers of the electrophotographic photosensitive drum and the driving member are aligned with precision.

The drum flange, at the driving side of the electrophotographic photosensitive drum is rotatably supported on the cartridge frame, so that process cartridge is correctly positioned relative to the main assembly of the image forming apparatus with the centered electrophotographic photosensitive drum.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an image forming apparatus, comprising:

an electrophotographic photosensitive drum having a cartridge coupling member at one end thereof, wherein said process cartridge is detachably mountable in a direction of an axis of said electrophotographic photosensitive drum, wherein said cartridge coupling member is engageable with a main assembly coupling member to receive a driving force for rotating said photosensitive drum;

process means actable on said electrophotographic photosensitive drum; and a projected shaft projected through said cartridge coupling member to the outside, said projected shaft penetrating through said photosensitive drum in its axial direction, said projected shaft being engageable with a hole of an engaging member provided in the main assembly.

2. A process cartridge according to claim 1, wherein said projected shaft penetrates said electrophotographic photosensitive drum at a center of said electrophotographic photosensitive drum and is projected out of the opposite ends of said electrophotographic photosensitive drum.

3. A process cartridge detachably mountable to a main assembly of an image forming apparatus, comprising:

an electrophotographic photosensitive drum having a cartridge coupling member at one end thereof, wherein said process cartridge is detachably mountable in a direction of an axis of said electrophotographic photosensitive drum, wherein said cartridge coupling member is engageable with a main assembly coupling member to receive a driving force for rotating said photosensitive drum, process means actable on said electrophotographic photosensitive drum;

a cartridge frame for supporting said process means and for rotatably supporting said electrophotographic photosensitive drum;

a drum shaft penetrating said electrophotographic photosensitive drum at a center thereof and projecting out of opposite ends of said electrophotographic photosensitive drum, said drum shaft being rotatably supported on said cartridge frame adjacent the other end of said electrophotographic photosensitive drum, wherein one end of said drum shaft is projected through said cartridge coupling member to the outside, and the one end being engageable with a hole of an engaging member of a driving member provided in the main assembly adjacent the other end of said electrophotographic photosensitive drum.

4. A process cartridge according to any one of claims 1–3, wherein said process cartridge contains the electrophotographic photosensitive drum and charging means, developing means or cleaning means as a unit, and said process cartridge is detachably mountable to the main assembly of the image forming apparatus as a unit.

5. A process cartridge according to any one of claims 1–3, wherein said process cartridge contains the electrophotographic photosensitive drum and at least one of charging means, developing means and cleaning means as a unit, and said process cartridge is detachably mountable to the main assembly of the image forming apparatus as a unit.

6. A process cartridge according to any one of claims 1–3, wherein said process cartridge contains at least a developing means and said electrophotographic photosensitive drum as a unit, and said process cartridge is detachably mountable to the main assembly of the image forming apparatus as unit.

7. A process cartridge according to claim 3, wherein said drum shaft is projected out of the coupling member so that when the coupling member is engaged with or disengage from a hole of an engaging member provided in the main assembly of said image forming apparatus, said drum shaft is engaged in or disengaged from a hole formed at a center of the engaging member.

8. An electrophotographic image forming apparatus, for forming an image on a recording material, to which a process cartridge is detachably mountable, comprising:

(a) mounting means for detachably mounting said process cartridge, said process cartridge including:

an electrophotographic photosensitive drum having a cartridge coupling member at one end thereof, wherein said process cartridge is detachably mountable in a direction of an axis of said electrophotographic photosensitive drum, wherein said cartridge coupling member is engageable with a main assembly coupling member to receive a driving force for rotating said photosensitive drum;

process means actable on said electrophotographic photosensitive drum;

a projected shaft projected through said cartridge coupling member to the outside, said projected shaft penetrating through said photosensitive drum in its axial direction, said projected shaft being engageable with a hole of an engaging member provided in the main assembly;

(b) the engaging member having the hole engageable with said projected shaft; and (c) feeding means for feeding the recording material.

9. An electrophotographic image forming apparatus, for forming an image on a recording material, to which a process cartridge is detachably mountable, comprising:

(a) mounting means for detachably mounting said process cartridge, said process cartridge including:

an electrophotographic photosensitive drum having a cartridge coupling member at one end thereof, wherein said process cartridge is detachably mountable in a direction of an axis of said electrophotographic photosensitive drum, wherein said cartridge coupling member is engageable with a main assembly coupling member to receive a driving force for rotating said photosensitive drum;

process means actable on said electrophotographic photosensitive drum;

a cartridge frame for supporting said process means and for rotatably supporting said electrophotographic photosensitive drum; and a drum shaft penetrating said electrophotographic photosensitive drum at a center thereof and projecting out of opposite ends of said electrophotographic photosensitive drum, said drum shaft being rotatably supported on said cartridge frame adjacent the other end of said electrophotographic photosensitive drum, wherein one end of said drum shaft is projected through said cartridge coupling member to the outside, and the one end being engageable with a hole of an engaging member of a driving member provided in the main assembly adjacent the other end of said electrophotographic photosensitive drum;

(b) the driving member having the engaging member with a hole, said drum shaft being engageable with the hole adjacent said one end of said electrophotographic photosensitive drum; and (c) feeding means for feeding the recording material.

* * * * *

UNITED STATES PATENT AND TRADEMARK OFFICE

CERTIFICATE OF CORRECTION

PATENT NO. : 6,289,189 B1
DATED : September 11, 2001
INVENTOR(S) : Atsushi Numagami et al.

It is certified that error appears in the above-identified patent and that said Letters Patent is hereby corrected as shown below:

Column 1,
Line 18, “medium” should read -- medium. --.
Line 40, “ion” should read -- on --.
Line 48, “improved” should read -- improves --.

Column 2,
Line 33, “7 in” should read -- 7 is --.
Line 60, “Perspective” should read -- perspective --.

Column 3,
Line 14, “ire.,” should read -- i.e., --.
Line 64, “portion” should read -- portions --.

Column 4,
Line 7, “two” should read -- a two --.
Line 11, “7, it” should read -- 7. It --.
Line 23, “drum,.” should read -- drum. --.
Line 42, “disposed” should read -- disposed. --.
Line 56, “in” (1st occurrence) should be deleted.

Column 5,
Line 42, “the,” should read -- the --.
Line 45, “are” should read -- is --.

Column 6,
Line 20, “transfer-residua” should read -- transfer-residual --.
Line 43, “7” should read -- 7. --.
Line 60, “1a,” should read -- 18, --.
Line 63, “13” should read -- 13. --.

Column 7,
Line 8, “4,” should read -- 4. --.
Line 16, “Shutter” should read -- shutter --.
Line 41, “extend” should read -- extends --.
Line 49, “inside” should read -- inside. --.

Column 8,
Line 51, “log” should read -- 10g --.

UNITED STATES PATENT AND TRADEMARK OFFICE

CERTIFICATE OF CORRECTION

PATENT NO. : 6,289,189 B1
DATED : September 11, 2001
INVENTOR(S) : Atsushi Numagami et al.

It is certified that error appears in the above-identified patent and that said Letters Patent is hereby corrected as shown below:

Column 9,
Line 57, “in” should read -- is --.
Line 58, “7” should read -- 7. --.

Column 10,
Line 25, “arrangements,” should read -- arrangement, --.
Line 41, “$X_1$” should read -- B --.

Column 11,
Line 4, “E” should read -- B --.
Line 11, “d” should read -- B --.
Line 17, “Main” should read -- main --.
Line 45, “an” should read -- on --.

Column 12,
Line 15, “wail” should read -- wall --.
Line 31, “the” should read -- the --.
Line 52, “beating” should read -- bearing --.

Column 13,
Line 28, “Collar” should read -- collar --.
Line 34, “dover” should read -- cover --.

Column 14,
Line 9, “Although this” should read -- This --.
Line 33, “embodiment” should read -- embodments --.
Line 48, “item 1,” should read -- Item 1, --.

Column 15,
Line 37, “and and” should read -- and --.

Column 16,
Line 23, “said and said” should read -- said drum shaft to prevent rotations of said drum shaft and said --.
Line 23, “said” (3rd occurrence) should read -- of said --.
Line 25, “said” (2nd occurrence) should be deleted.
Line 67, “projects” should read -- projecting --.

UNITED STATES PATENT AND TRADEMARK OFFICE

CERTIFICATE OF CORRECTION

PATENT NO. : 6,289,189 B1
DATED : September 11, 2001
INVENTOR(S) : Atsushi Numagami et al.

It is certified that error appears in the above-identified patent and that said Letters Patent is hereby corrected as shown below:

Column 17,
Line 4, “drum,” should read -- drum; --.
Line 4, “said drum shaft being rotatably supported on” should be deleted.
Lines 5-6 should be deleted.
Line 57, “is” should read -- is supported on a cartridge frame, and a projected --.
Line 58, “shaft” should read -- shaft adjacent a driving side is engageable with a hole 52a --.
Line 65, “membering” should read -- member --.

Column 19,
Line 14, “disengage” should read -- disengaged --.

Signed and Sealed this

Twenty-eighth Day of January, 2003

JAMES E. ROGAN
*Director of the United States Patent and Trademark Office*